US011450274B2

(12) United States Patent
Zhang et al.

(10) Patent No.: US 11,450,274 B2
(45) Date of Patent: Sep. 20, 2022

(54) DISPLAY PANEL, DRIVING METHOD OF DISPLAY PANEL, AND DISPLAY DEVICE

(71) Applicants: WUHAN TIANMA MICROELECTRONICS CO., LTD., Wuhan (CN); WUHAN TIANMA MICROELECTRONICS CO., LTD. SHANGHAI BRANCH, Shanghai (CN)

(72) Inventors: Mengmeng Zhang, Shanghai (CN); Xingyao Zhou, Shanghai (CN)

(73) Assignees: WUHAN TIANMA MICROELECTRONICS CO., LTD., Wuhan (CN); WUHAN TIANMA MICROELECTRONICS CO., LTD. SHANGHAI BRANCH, Shanghai (CN)

( * ) Notice: Subject to any disclaimer, the term of this patent is extended or adjusted under 35 U.S.C. 154(b) by 0 days.

(21) Appl. No.: 17/136,402

(22) Filed: Dec. 29, 2020

(65) Prior Publication Data

US 2022/0139307 A1 May 5, 2022

(30) Foreign Application Priority Data

Oct. 30, 2020 (CN) ..... 202011198070.4

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/08* (2013.01)

(58) Field of Classification Search
CPC .. G09G 3/3208; G09G 3/3233; G09G 3/3258; G09G 3/3266; G09G 3/3291;
(Continued)

(56) References Cited

U.S. PATENT DOCUMENTS

2017/0270853 A1* 9/2017 Xiang ..... G09G 3/3275
2018/0130420 A1* 5/2018 Gao ..... G09G 3/3233
(Continued)

FOREIGN PATENT DOCUMENTS

CN 106710529 A 5/2017
CN 107256690 A 7/2017
(Continued)

OTHER PUBLICATIONS

Office Action for related Chinese Application No. 202011198070.4; report dated Jun. 11, 2021.

*Primary Examiner* — Michael J Eurice
(74) *Attorney, Agent, or Firm* — von Briesen & Roper, s.c.

(57) ABSTRACT

Disclosed are a display panel, a driving method of the display panel, and a display device. A switching module of a pixel circuit in the display panel includes a first transistor and a second transistor. A second electrode of the first transistor is electrically connected to a first electrode of the second transistor at a first node. A second electrode of the second transistor is electrically connected to a gate electrode of a driving transistor at a second node. The driving transistor is configured to provide a driving current for a light emitting module according to a potential of the second node in a light emitting phase. An input end of each potential adjustment module is electrically connected to the second node of one pixel circuit, and an output end of each potential adjustment module is electrically connected to the first node of at least one pixel circuit.

20 Claims, 22 Drawing Sheets

(58) Field of Classification Search
CPC ... G09G 2300/0439; G09G 2300/0842; G09G 2300/0861; G09G 2300/0819; G09G 2310/06; G09G 2310/08; H01L 27/32
See application file for complete search history.

(56) References Cited

U.S. PATENT DOCUMENTS

| | | | | |
|---|---|---|---|---|
| 2018/0151118 | A1* | 5/2018 | Chung | H01L 27/3262 |
| 2019/0035875 | A1* | 1/2019 | Xin | G09G 3/3233 |
| 2021/0193025 | A1* | 6/2021 | Xu | G09G 3/3677 |

FOREIGN PATENT DOCUMENTS

| | | | |
|---|---|---|---|
| CN | 107256690 | A | 10/2017 |
| CN | 110751927 | A | 2/2020 |
| CN | 111179859 | A | 5/2020 |
| CN | 111613177 | A | 9/2020 |

* cited by examiner

DISPLAY PANEL, DRIVING METHOD OF DISPLAY PANEL, AND DISPLAY DEVICE

CROSS-REFERENCE TO RELATED APPLICATIONS

This application claims priority to Chinese patent application No. 202011198070.4 filed with the CNIPA on Oct. 30, 2020, the disclosure of which is incorporated herein by reference in its entirety.

TECHNICAL FIELD

Embodiments of the present disclosure relate to the field of display technologies, and in particular to a display panel, a driving method of a display panel, and a display device.

BACKGROUND

At present, an organic light-emitting diode (OLED) display panel is widely popular with people due to the advantages of the OLED display panel, such as the self-illumination, the high contrast, the thin thickness, the fast response speed, the applicability to flexible panels and the like at the same time.

An OLED element of the OLED display panel belongs to a current driving type element, and a pixel circuit corresponding to the OLED element needs to be disposed to provide a driving current for the OLED element, so that the OLED element may emit light. A pixel driving circuit of the OLED display panel generally includes a driving transistor, and the driving transistor may generate a driving current for driving the OLED element according to a voltage of a gate electrode of the driving transistor. Other transistors which are directly and electrically connected to the gate electrode of the driving transistor include a double-gate transistor. Due to the existence of a coupling capacitor of the double-gate transistor, the double-gate transistor has a leakage phenomenon, so that the voltage of the gate electrode of the driving transistor is unstable. Finally, the light emitting brightness of the light-emitting element is affected, thus affecting the display effect.

SUMMARY

The present disclosure provides a display panel, a driving method of a display panel, and a display device, so as to improve an unstable gate voltage of the driving transistor due to the electric leakage of a double-gate transistor, thus improving the display effect of the display panel. In an embodiment, the present disclosure provides a display panel. The display panel includes multiple pixel circuits arranged in an array and multiple potential adjustment modules. Each pixel circuit includes a driving transistor, at least one switching module and a light emitting module; each of the at least one switching module includes a first transistor and a second transistor; a second electrode of the first transistor is electrically connected to a first electrode of the second transistor at a first node; a second electrode of the second transistor is electrically connected to a gate electrode of the driving transistor at a second node; and the driving transistor is configured to provide a driving current for the light emitting module according to a potential of the second node in a light emitting phase. An input end of each potential adjustment module is electrically connected to the second node of one of the multiple pixel circuits, an output end of each potential adjustment module is electrically connected to the first node of at least one of the multiple pixel circuits; and each multiple potential adjustment module is configured to adjust a potential of the first node according to the potential of the second node, so as to control, in the light emitting phase of the multiple pixel circuits, a potential difference between the first node of each pixel circuit and the second node of the each pixel circuit to be within a preset potential difference range.

In an embodiment, the present disclosure further provides a driving method of a display panel. The driving method is applied to the display panel as described in the first aspect. A driving period of each pixel circuit in the display panel includes a potential adjustment phase and a light emitting phase. The method includes steps described below, in the potential adjustment phase, each potential adjustment module adjusts the potential of the first node according to the potential of the second node; and in the light emitting phase, the potential difference between the potential of the first node of each pixel circuit and the potential of the second node of the each pixel circuit is controlled to be within the preset potential difference range, and the driving transistor provides the driving current for the light emitting module according to the potential of the second node.

In an embodiment, the present disclosure further provides a display device. The display device includes the display panel as described in the first aspect.

DETAILED DESCRIPTION

Figure 1:
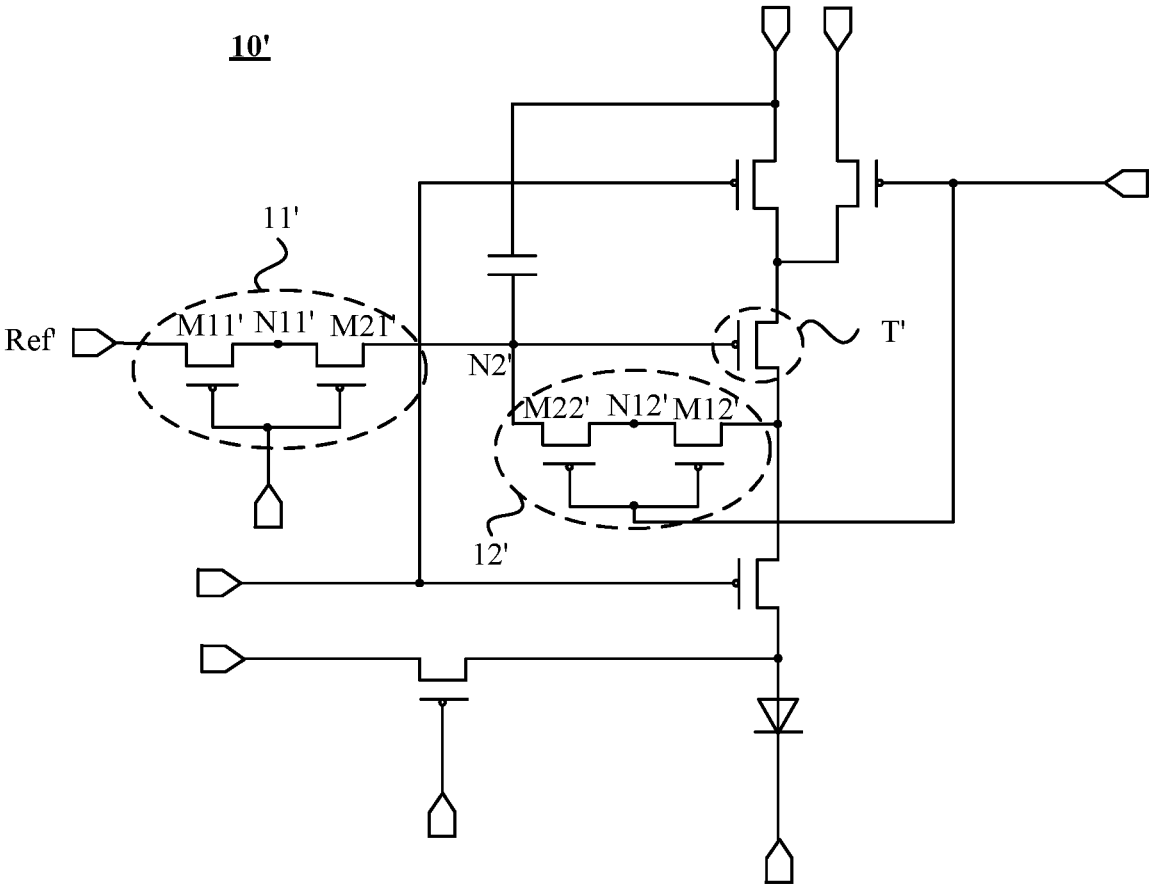
FIG. 1 is a schematic structural view of a pixel circuit in the related art.

The present disclosure will be further described in detail in conjunction with the drawings and embodiments below. It should be understood that the specific embodiments described herein are merely used for explaining the present disclosure and are not intended to limit the present disclosure. In addition, it should also be noted that, for ease of description, only some, but not all, of the structures related to the present disclosure are shown in the drawings.

FIG. 1 is a schematic structural view of a pixel circuit in the related art. As shown in FIG. 1, the pixel circuit 10' in the related art includes a driving transistor T', a first switching module 11' and a second switching module 12'. The first switching module 11' and the second switching module 12' are both composed of a double-gate transistor; each double-gate transistor includes two transistors, i.e., a first transistor (M11', M12') and a second transistor (M21', M22'), respectively. A second electrode of the first transistor (M11', M12') is electrically connected to a first electrode of the second transistor (M21', M22') at a first node (N11', N12'); a second electrode of the second transistor (M21', M22') is electrically connected to a gate electrode of the driving transistor T' at a second node N2', and a gate electrode of the first transistor (M11', M12') and a gate electrode of the second transistor (M21', M22'), which belong to a same double-gate transistor, are configured to receive a same scan signal. When the first switching module 11' is configured to transmit an initialization signal of an initialization signal end to the gate electrode of the driving transistor T' in an initialization phase, the scan signal received by the gate electrode of the first transistor M11' of the first switching module 11' and the gate electrode of the second transistor M21' of the first switching module 11' may control the first transistor M11' and the second transistor M21' of the first switching module 11' to be turned on in the initialization phase, while the scan signal may control the first transistor M11' and the second transistor M21' of the first switching module 11' to be turned off in other phases, so that the gate electrode of the first transistor M11' and the gate electrode of the second transistor M21' in the initialization phase are an enable potential of the scan signal, while the gate electrode of the first transistor M11' and the gate electrode of the second transistor M21' are a non-enable potential of the scan signal in a light emitting phase. Since both the gate electrode of the first transistor M11' and the gate electrode of the second transistor M21' form a parasitic capacitance with the first node N11' and due to the coupling effect of the parasitic capacitance, the potential of the gate electrode of the first transistor M11' and the potential of the gate electrode of the second transistor M21' are coupled to the first node N11' at the same time, so that a relatively large potential difference exists between the first node N11' and the second node N2' in the light emitting phase, thus forming a current path, and an electric leakage phenomenon occurs. Similarly, when the second switching module 12' is configured to compensate the gate electrode of the driving transistor T' with a threshold voltage of the driving transistor T' in a data writing phase, the scan signal received by the gate electrode of the first transistor M12' of the second switching module 12' and the gate electrode of the second transistor M22' of the second switching module 12' may control the first transistor M12' and the second transistor M22' of the second switching module 12' to be turned on in the data writing phase, while the scan signal may control the first transistor M12' and the second transistor M22' of the second switching module 12' to be turned off in other phases. Therefore, the potential of the gate electrode of the first transistor M12' and the potential of the gate electrode of the second transistor M22' are coupled to the first node N12' in the light emitting phase, so that a relatively large potential difference exists between the first node N12' and the second node N2', thus forming a current path, and the electric leakage phenomenon occurs. Moreover, in a high-temperature environment, carriers in transistors have high activities, and the electric leakage of the double-gate transistor is more obvious.

As such, when the double-gate transistor electrically connected to the driving transistor T' has the electric leakage phenomenon, the potential of the second node NT is affected, so that the driving current which is provided by the driving transistor T' according to the potential of the second node N2' and provided to a light emitting module changes, and light emitting brightness of the light emitting module is affected, thus affecting the display effect of the display panel. Especially for a low-frequency driving pixel circuit, a writing time interval of light emitting signals of two adjacent frames is large, and within the writing time interval of the light emitting signals of two adjacent frames, if the light emitting brightness of the light emitting module is continuously reduced, this may cause display screen shaking.

An embodiment of the present disclosure provides a display panel. The display panel includes multiple pixel circuits arranged in an array and multiple potential adjustment modules. Each pixel circuit includes a driving transistor, at least one switching module and a light emitting module; each of the at least one switching module includes a first transistor and a second transistor; a second electrode of the first transistor is electrically connected to a first electrode of the second transistor at a first node; a second electrode of the second transistor is electrically connected to a gate electrode of the driving transistor at a second node; and the driving transistor is configured to provide a driving current for the light emitting module according to a potential of the second node in a light emitting phase. An input end of each potential adjustment module is electrically connected to the second node of one of the multiple pixel circuits, an output end of each potential adjustment module is electrically connected to the first node of at least one of the multiple pixel circuits; and each potential adjustment module is configured to adjust a potential of the first node according to the potential of the second node, so as to control, in the light emitting phase of the multiple pixel circuits, a potential difference between the first node of each pixel circuit and the second node of the each pixel circuit to be within a preset potential difference range.

By adopting the above technical schemes, the potential adjustment modules are additionally disposed in the display panel, the input end of each potential adjustment module is electrically connected to the second node of one pixel circuit, and the output end of each potential adjustment module is electrically connected to the first node of at least one pixel circuit, so that the potential adjustment module may adjust the potential of the second node of at least one pixel circuit according to the potential of the first node of one pixel circuit, and in the light emitting phase of each pixel circuit, the potential difference between the first node and the second node of each pixel circuit may be within the preset potential difference range, so that the electric leakage phenomenon generated by the potential difference between the first node and the second node is improved. Therefore, in the light emitting phase of the pixel circuits, the potential of the second node can be stabilized, which ensures that the driving transistor provides a stable driving current for the light emitting module, and that the light emitting module has the stable light emitting brightness. Meanwhile, for a low-frequency driving display panel, within an interval time of writing data signals of two adjacent frames, the light emitting module may emit light stably and the display screen shaking is improved. Moreover, the potential adjustment module adjusts the potential of the first node of the pixel circuit according to the potential of the second node of the pixel circuit, so that the potential difference between the first node and the second node of each pixel circuit can be accurately controlled to be within the preset potential difference range, and a corresponding potential adjustment signal for adjusting the potential of the first node does not need to be additionally provided, which is conducive to simplifying the structure of the display panel and reducing the power consumption of the display panel.

The above contents are core ideas of the present disclosure, and the technical schemes in the embodiments of the present disclosure will be clearly and completely described below in combination with the attached drawings in the embodiments of the present disclosure. All other embodiments, which may be obtained by those of ordinary skill in the art based on the embodiments of the present disclosure without any creative work, belong to the protection scope of the present disclosure.

In the embodiments of the present disclosure, the output end of each potential adjustment module may be electrically connected to at least one pixel circuit, namely, the output end of each potential adjustment module may be electrically connected to one pixel circuit, two pixel circuits, or multiple pixel circuits; and a pixel circuit electrically connected to the output end of a potential adjustment module may include a same pixel circuit as the pixel circuit electrically connected to the input end of the potential adjustment module, or, pixel circuits electrically connected to the input end and the output end of the potential adjustment module are different. The technical schemes of the embodiments of the present disclosure will be exemplarily described below for different situations.

Figure 2:
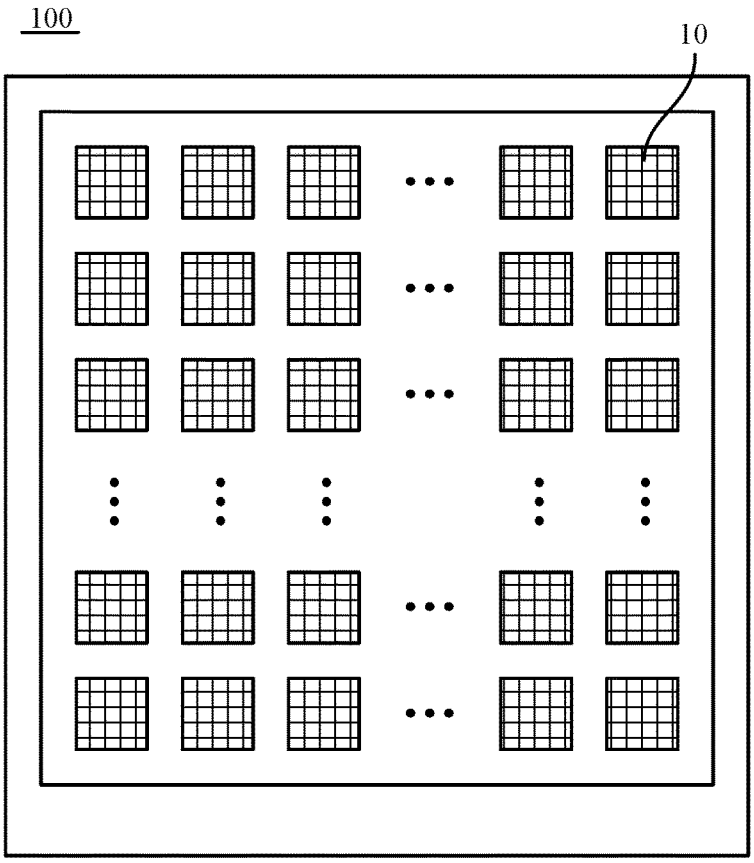
FIG. 2 is a schematic structural view of a display panel provided by an embodiment of the present disclosure.
Figure 3:
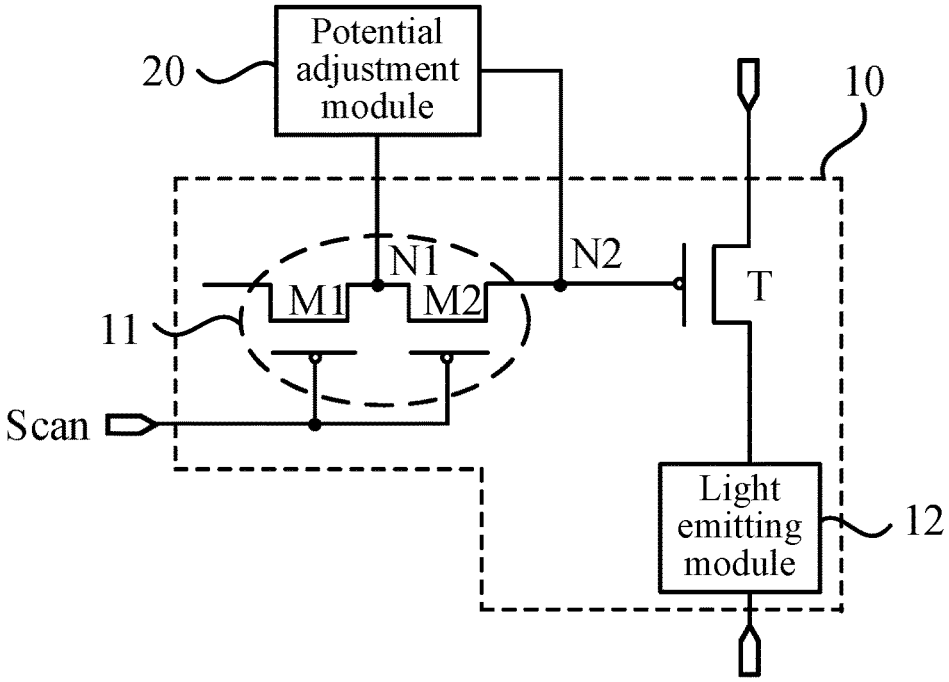
FIG. 3 is a schematic structural view of a pixel circuit in a display panel provided by an embodiment of the present disclosure.

FIG. 2 is a schematic structural view of a display panel provided by an embodiment of the present disclosure, and FIG. 3 is a schematic structural view of a pixel circuit in a display panel provided by an embodiment of the present disclosure. Combining FIG. 2 with FIG. 3, a display panel 100 includes multiple pixel circuits 10 arranged in an array. Each pixel circuit 10 includes a driving transistor T, a switching module 11 and a light emitting module 12. The switching module 11 includes a first transistor M1 and a second transistor M2; a second electrode of the first transistor M1 is electrically connected to a first electrode of the second transistor M2 at a first node N1; a second electrode of the second transistor M2 is electrically connected to a gate electrode of the driving transistor T at a second node N2, and a gate electrode of the first transistor M1 and a gate electrode of the second transistor M2 receive a same scan signal Scan, so that the first transistor M1 and the second transistor M2 are turned on or off under the control of the scan signal Scan. When the scan signal Scan is an enable potential, the first transistor M1 and the second transistor M2 are turned on, and a signal received by a first electrode of the first transistor M1 may be transmitted to the gate electrode of the driving transistor T (i.e., the second node N2) through the turned-on first transistor M1 and the turned-on second transistor M2. In the light emitting phase, the scan signal Scan is a non-enable potential, the first transistor M1 and the second transistor M2 are turned off, and the driving transistor T may provide a driving current for the light emitting module 12 according to a potential of the second node N2 so as to drive the light emitting module 12 to emit light.

However, due to a fact that both the gate electrode of the first transistor M1 and the gate electrode of the second transistor M2 form a parasitic capacitance with the first node N1, when the scan signal Scan received by the gate electrode of the first transistor M1 and the gate electrode of the second transistor M2 jumps from the enable potential to the non-enable potential, the potential of the first node N1 may be changed due to the coupling effect of the parasitic capacitance, which will result in a relatively large potential difference between the first node N1 and the second node N2. At this time, through the potential adjustment module 20 disposed in the display panel 100, an input end of the potential adjustment module 20 is electrically connected to the second node N2 of the pixel circuit 10, and an output end of the potential adjustment module 20 is electrically connected to the first node N1 of the pixel circuit 10, so that the potential adjustment module 20 may adjust the potential of the first node N1 according to the potential of the second node N2, so as to control, in the light emitting phase of the multiple pixel circuits 10, a potential difference between the potential of the first node N1 of the pixel circuit 10 and the potential of the second node N2 of the pixel circuit 10 to be within a preset potential difference range. Illustratively, in a low-frequency and low-brightness display panel, the potential difference $|\Delta V|$ between the first node N1 and the second node N2 of the pixel circuit 10 may have a value range of $|\Delta V| \leq 2.5V$.

As such, when the potential difference between the potential of the first node N1 of the pixel circuit 10 and the potential of the second node N2 of the pixel circuit 10 is within the preset potential difference range, the leakage current generated by the potential difference between the first node N1 and the second node N2 of the pixel circuit 10 can be reduced; therefore, the potential of the second node N2 can be ensured to be stable in the light emitting phase; so that the driving transistor T provides a stable driving current for the light emitting module 12 according to the potential of the second node N2, the light emitting module 12 is ensured to emit light stably, and the display effect of the display panel is improved.

Correspondingly, for the low-frequency driving display panel, switching from a current frame of picture to a next frame of picture takes a long time. When the potential difference between the first node N1 and the second node N2 of the pixel circuit 10 is adjusted to be the preset potential difference, it may ensure that the light emitting module 12 of each pixel circuit 10 keeps light emitting stably in the light emitting phase; therefore avoiding the display screen shaking caused by a relatively long switching time of each frame of picture.

Moreover, when the potential adjustment module 20 adjusts the potential of the first node N1 of this pixel circuit 10 according to the potential of the second node N2 of the pixel circuit 10, the potential difference between the first node N1 of the pixel circuit 10 and the second node N2 of the pixel circuit 10 may be accurately adjusted to the preset potential difference range, so that the potential of the second node N2 of the pixel circuit 10 is kept stable; therefore improving the display quality of the display panel.

It should be noted that FIG. 3 is merely an exemplary drawing of an embodiment of the present disclosure, and it is exemplarily shown in FIG. 3 that the pixel circuit electrically connected to the input end of the potential adjustment module 20 and the pixel circuit electrically connected to the output end of the potential adjustment module 10 are a same pixel circuit; however, the pixel circuit electrically connected to the output end of the potential adjustment module in the embodiments of the present disclosure may further include a pixel circuit different from the pixel circuit electrically connected to the input end of the potential adjustment module.

Figure 4:
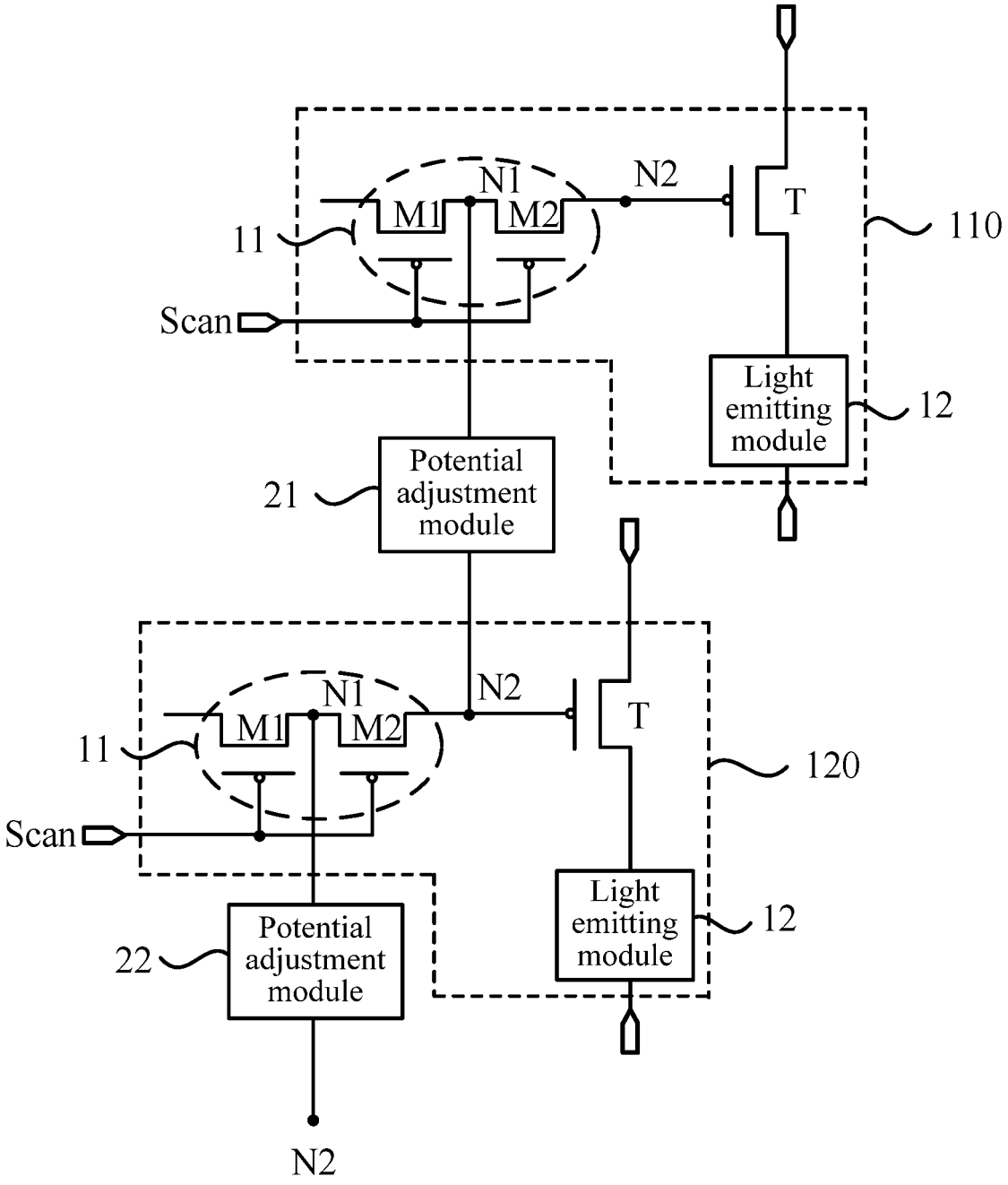
FIG. 4 is a schematic structural view of yet another pixel circuit in a display panel provided by an embodiment of the present disclosure.

Exemplary, FIG. 4 is a schematic structural view of yet another pixel circuit in a display panel provided by an embodiment of the present disclosure. The same parts of FIG. 4 and FIG. 3 will not be described in detail herein, only differences between FIG. 4 and FIG. 3 are exemplarily illustrated here. As shown in FIG. 4, an input end of a potential adjustment module 21 is electrically connected to a second node N2 of a pixel circuit 120, an output end of the potential adjustment module 21 is electrically connected to a first node N1 of a pixel circuit 110, and a first node N1 of the pixel circuit 120 may be electrically connected to the second node N2 of another pixel circuit through a potential adjustment module 22. As such, the potential adjustment module 21 may adjust the potential of the first node N1 of the pixel circuit 110 according to the potential of the second node N2 of the pixel circuit 120, so that a potential difference between the first node N1 of the pixel circuit 110 and the second node N2 of the pixel circuit 110 may be within the preset potential difference range in the light emitting phase of the pixel circuit 110; therefore, preventing the leakage of a switching module 11 of the pixel circuit 110, due to a relatively large potential difference between the first node N1 of the pixel circuit 110 and the second node N2 of the pixel circuit 110, and the light emitting module 12 of the pixel circuit 110 emitting light stably.

Similarly, the potential adjustment module 22 may adjust the potential of the first node N1 of the pixel circuit 120 according to a potential of the second node N2 of another pixel circuit, so that, in the light emitting phase of the pixel circuit 120, a potential difference between the first node N1 of the pixel circuit 120 and the second node N2 of the pixel circuit 120 may be within the preset potential difference range, and the light emitting module 12 of the pixel circuit 120 is ensured to emit light stably.

Figure 5:
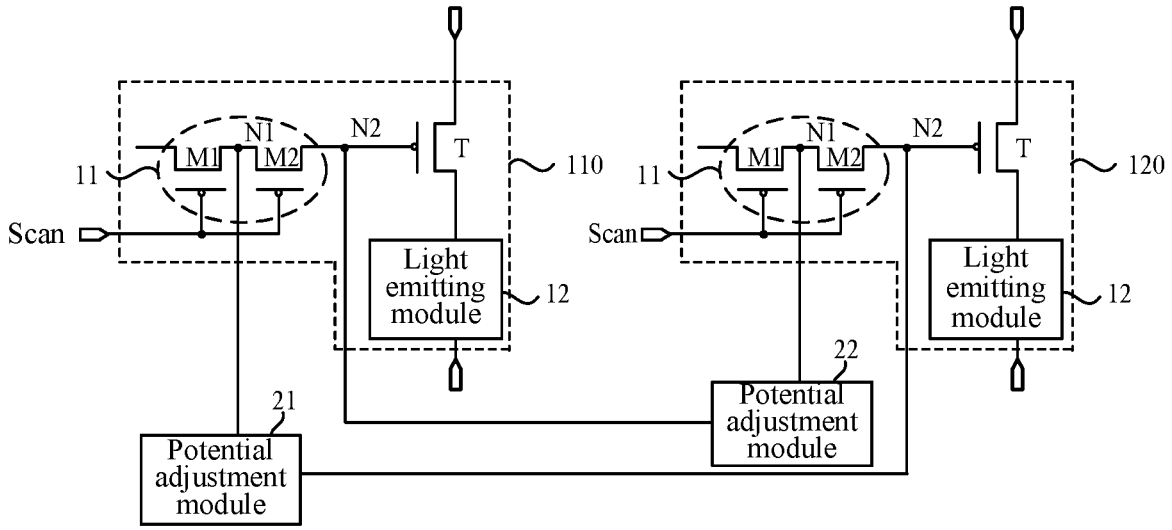
FIG. 5 is a schematic structural view of yet another pixel circuit in a display panel provided by an embodiment of the present disclosure.

Alternatively, as shown in FIG. 5, the input end of the potential adjustment module 21 is electrically connected to the second node N2 of the pixel circuit 120, and the output end of the potential adjustment module 21 is electrically connected to the first node N1 of the pixel circuit 110; the input end of the potential adjustment module 22 is electrically connected to the second node N2 of the pixel circuit 110, and the output end of the potential adjustment module 22 is electrically connected to the first node N1 of the pixel circuit 120; at this time, the potential adjustment module 21 may adjust the potential of the first node N1 of the pixel circuit 110 according to the potential of the second node N2 of the pixel circuit 120; and the potential adjustment module 22 may adjust the potential of the first node N1 of the pixel circuit 120 according to the potential of the second node N2 of the pixel circuit 110.

It should be noted that the pixel circuit in the embodiments of the present disclosure includes at least one switching module, so that the pixel circuit may include one switching module or multiple switching modules, and the functions of each switching module are different.

The at least one switching module includes a first switching module; a first electrode of the first transistor of the first switching module is configured to receive an initialization signal, a gate electrode of the first transistor of the first switching module and a gate electrode of the second transistor of the first switching module are both configured to receive a first scan signal; and the first switching module is configured to transmit the initialization signal to the gate electrode of the driving transistor in an initialization phase; and/or, the at least one switching module includes a second switching module; a first electrode of the first transistor of the second switching module is electrically connected to a second electrode of the driving transistor, a gate electrode of the first transistor of the second switching module and a gate electrode of the second transistor of the second switching module are both configured to receive a second scan signal; and the second switching module is configured to compensate the gate electrode of the driving transistor with a threshold voltage of the driving transistor in a data writing phase.

Figure 6:
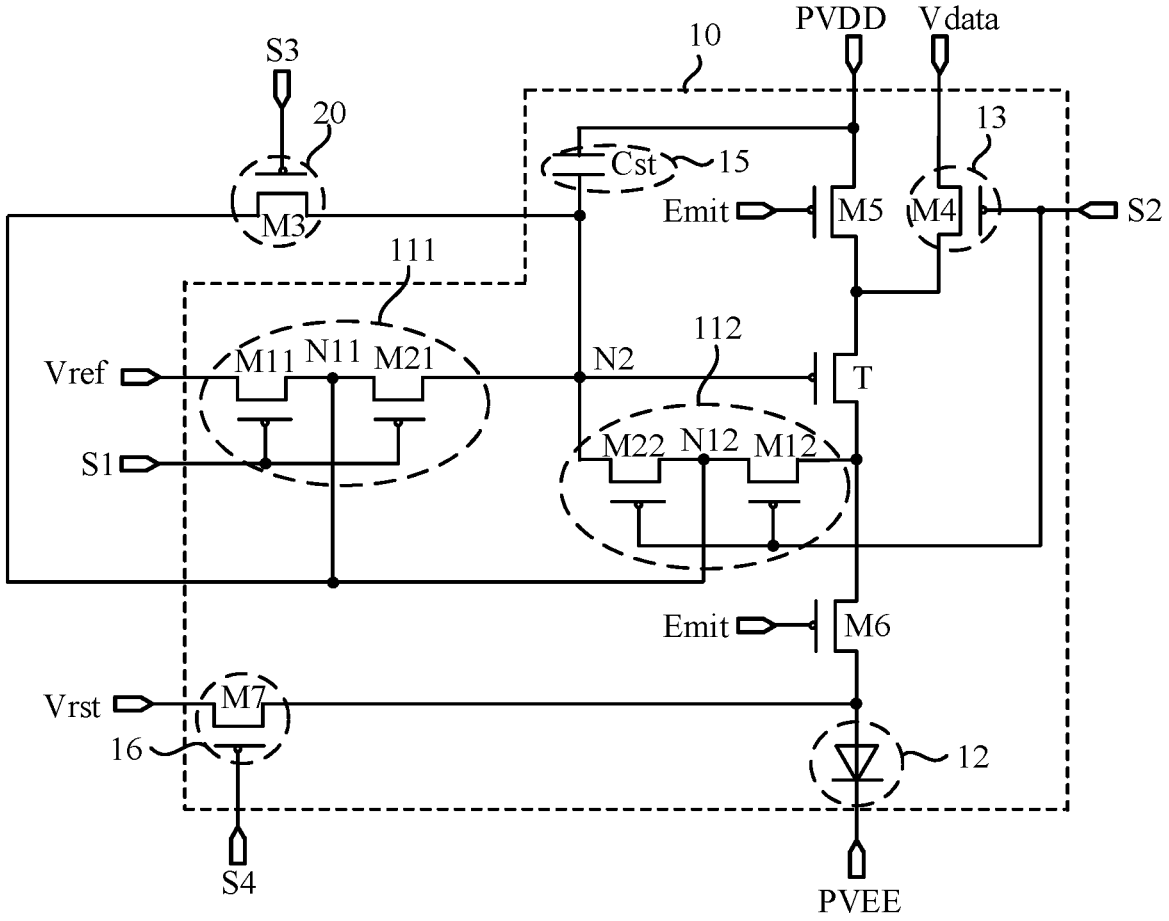
FIG. 6 is a schematic structural view of yet another pixel circuit in a display panel provided by an embodiment of the present disclosure.

Illustratively, FIG. 6 is a schematic structural view of yet another pixel circuit in a display panel provided by an embodiment of the present disclosure. As shown in FIG. 6, for example, pixel circuits electrically connected to the potential adjustment module 20 are the same pixel circuit. The pixel circuit 10 includes two switching modules, namely, a first switching module 111 and a second switching module 112. At this time, a first electrode of a first transistor M11 of the first switching module 111 receives an initialization signal Vref, and a gate electrode of the first transistor M11 and a gate electrode of the second transistor M21 of the first switching module 111 both receive a first scan signal S1. The first scan signal S1 may control the first transistor M11 and the second transistor M21 in the first switching module 111 to be turned on in an initialization phase, so that, the initialization signal Vref received by the first electrode of the first transistor M11 of the first switching module 111 may be transmitted to a gate electrode of a driving transistor, i.e., a second node N2, through the turned-on first transistor M11 and the turned-on second transistor M21 in the initialization phase. In other phases, the first scan signal S1 controls the first transistor M11 and the second transistor M21 in the first switching module 111 to be turned off. A first electrode of a first transistor M12 of the second switching module 112 is electrically connected to a second electrode of the driving transistor T, and a gate electrode of the first transistor M12 and a gate electrode of the second transistor M22 of the second switching module 112 both receive a second scan signal S2; the second scan signal S2 may control the first transistor M12 and the second transistor M22 in the second switching module 112 to be turned on in a data writing phase, so that, a data signal Vdata may be written into the gate electrode of the driving transistor T in the data writing phase through the driving transistor T as well as the first transistor M12 and the second transistor M22 of the second switching module 112; a threshold voltage of the driving transistor T is compensated for the gate electrode of the driving transistor T, namely, the second node; however, in other phases, the second scan signal S2 controls the first transistor M12 and the second transistor M22 in the second switching module 112 to be turned off.

Correspondingly, a second electrode of the first transistor M11 in the first switching module 111 is electrically connected to a first electrode of the second transistor M21 in the first switching module 111 at a first node N11, and a second electrode of the first transistor M12 in the second switching module 112 is electrically connected to a first electrode of the second transistor M22 in the second switching module 112 at a first node N12. At this time, an output end of the potential adjustment module 20 will be electrically connected to the first node N11 of the first switching module 111 and the first node N12 of the second switching module 112 at the same time. The potential adjustment module 20 may adjust potentials of the first nodes N11 and N12 of the pixel circuit 10 simultaneously according to the potential of the second node N2 of the pixel circuit 10, so that a potential difference between the first nodes N11 and N12 and the second node N2 is within the preset potential difference range in the light emitting phase, so as to ensure that the potential of the second node N2 is stable in the light emitting phase; therefore, the driving transistor T is enabled to provide a stable driving current to the light emitting module 12 according to the potential of the second node N2 to drive the light emitting module 12 to emit light stably.

It should be noted that, the technical schemes of the embodiments of the present disclosure are exemplarily explained in FIG. 6 by using an example in which each pixel circuit includes two switching modules; however, in an embodiment of the present disclosure, the switching module of each pixel circuit may only include one first switching module. Alternatively, the switching module of each pixel circuit may only include one second switching module; for the similarities, reference is made to the description of FIG. 6, which will not be described in detail herein. For ease of description, the technical schemes of the embodiments of the present disclosure are exemplarily explained in the embodiments of the present disclosure by using an example in which each pixel circuit includes two switching modules, namely a first switching module and a second switching module.

Meanwhile, the technical schemes of the embodiments of the present disclosure are exemplarily explained in FIG. 6 by using an example in which the potential adjustment module 20 is electrically connected to a same pixel; when the potential adjustment module 20 is electrically connected to different pixel circuits respectively, the technical principle thereof is similar to the situation shown in FIG. 6, which will not be described in detail herein.

Moreover, in the embodiments of the present disclosure, on the premise that the potential adjustment module may adjust the potential difference between the first node of the pixel circuit and the second node of the pixel circuit to be the preset potential difference range and the stable light emitting of the light emitting module in each pixel circuit is not affected, the adjustment process of the potential adjustment module and a structure of the potential adjustment module are not limited in the embodiments of the present disclosure.

When a pixel circuit electrically connected to the output end of the potential adjustment module is a first pixel circuit and a pixel circuit electrically connected to the input end of the potential adjustment module is a second pixel circuit, the potential adjustment module may include a potential adjustment transistor; a first electrode of the potential adjustment transistor is electrically connected to the second node of the second pixel circuit, and a second electrode of the potential adjustment transistor is electrically connected to the first node of the first pixel circuit; a gate electrode of the potential adjustment transistor is configured to receive a third scan signal; and the potential adjustment transistor is turned on or off under the control of the third scan signal.

Figure 7:
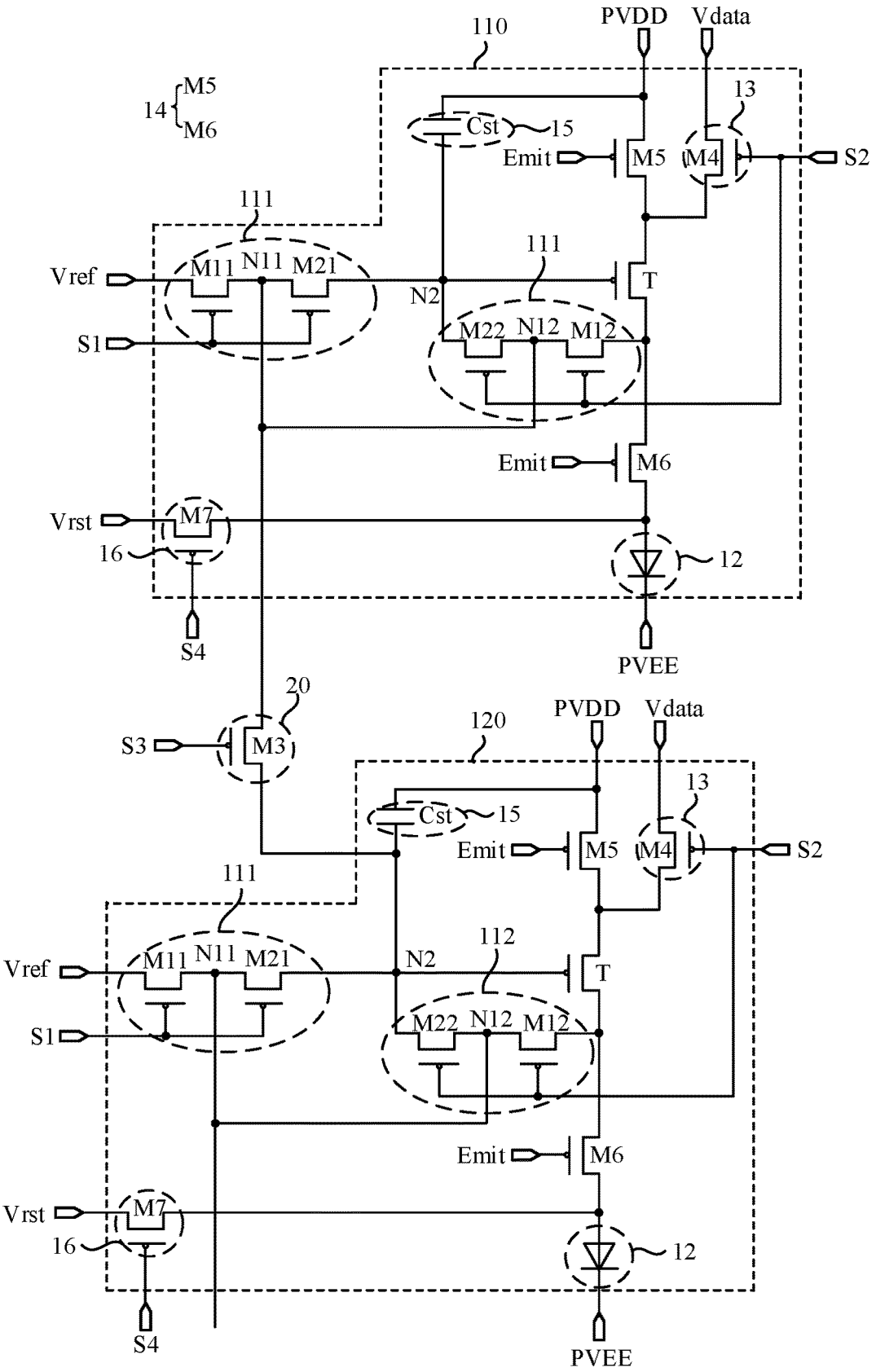
FIG. 7 is a schematic structural view of yet another pixel circuit in a display panel provided by an embodiment of the present disclosure.

Illustratively, FIG. 7 is a schematic structural view of yet another pixel circuit in a display panel provided by an embodiment of the present disclosure. As shown in FIG. 7, that a first pixel circuit 110 electrically connected to the output end of the potential adjustment module 20 and a second pixel circuit 120 electrically connected to the input end of the potential adjustment module 20 are different pixel circuits is used as an example. A first electrode of a potential adjustment transistor M3 is electrically connected to a second node N2 of the second pixel circuit 120, a second electrode of the potential adjustment transistor M3 is electrically connected to first nodes N11 and N12 of the first pixel circuit 110, a gate electrode of the potential adjustment transistor M3 receives a third scan signal S3, and the third scan signal may control the potential adjustment transistor M3 to be turned on or off. As such, when the third scan signal S3 controls the potential adjustment transistor M3 to be turned on, the first nodes N11 and N12 of the first pixel circuit 110 and the second node N2 of the second pixel circuit 120 form a path, and a potential of the second node N2 of the second pixel circuit 120 may be transmitted to the first nodes N11 and N12 of the first pixel circuit 110 through the turned-on potential adjustment transistor M3, so that potentials of the first nodes N11 and N12 of the first pixel circuit 110 are consistent with the potential of the second node N2 of the second pixel circuit 120. At this time, for a low-frequency and low-brightness display panel, the second node N2 of each pixel circuit in each frame of picture has a relatively small potential difference, which may be less than 2.5 V, for example, when the potentials of the first nodes N11 and N12 of the first pixel circuit 110 are adjusted to be consistent with the potential of the second node N2 of the second pixel circuit 120, a potential difference between the first nodes N11 and N12 of the first pixel circuit 110 and the second node N2 of the first pixel circuit 110 may be kept within the preset potential difference range, so that the potential of the second node N2 in the first pixel circuit 110 can be stabilized, and the light emitting module 12 of the first pixel circuit 110 can emit light stably.

Furthermore, in an existing display panel, scan signals provided to each pixel circuit will generally vary in the range of −7V to 8V, while a maximum potential difference between second nodes of pixel circuits in one frame of display picture is $|\Delta V'| \leq 6.5V$. As such, when transistors of the pixel circuits in the display panel are P-type transistors, and the scan signal received by the gate electrodes of the first transistor and the second transistor of the switching module is changed from an enable potential VGL to a non-enable potential VGH, the potential of the gate electrode of the first transistor and the potential of the gate electrode of the second transistor are both increased by 15V, and due to the coupling effect of the capacitor, the potential of the first node electrically connected to the second electrode of the first transistor and the first electrode of the second transistor is increased by 15V accordingly, which is more than twice the maximum potential difference $|\Delta V'|$ between the second nodes of pixel circuits in one frame of display picture.

With continued reference to FIG. 7, when the potential adjustment transistor M3 transmits the signal from the second node N2 of the second pixel circuit 120 to the first nodes N11 and N12 of the first pixel circuit 110, the potentials of the first nodes N11 and N12 of the first pixel circuit 110 are kept consistent with the potential of the second node N2 of the second pixel circuit 120, so that the potential difference between the first nodes N11 and N12 of the first pixel circuit 110 and the second node N2 of the first pixel circuit 110 is $|\Delta V| \leq 6.5V$, which significantly reduces the potential difference between the first nodes N11 and N12 of the first pixel circuit 110 and the second node N2 of the first pixel circuit 110 as compared to the case where the potentials of the first nodes N11 and N12 in the first pixel circuit 110 are not adjusted by using the potential adjustment transistor M3, therefore, the leakage current generated by the potential difference between the first nodes N11 and N12 of the first pixel circuit 110 and the second node N2 of the first pixel circuit 110 can be reduced, which is conducive to stabilizing the potential of the second node N2 of the first pixel circuit 110, so that the driving transistor T of the first pixel circuit 110 can provide the stable driving current to drive the light emitting module 12 to emit light stably.

Similarly, first nodes N11 and N12 of the second pixel circuit 120 may be electrically connected to the second node N2 of the second pixel circuit 120 through another potential adjustment transistor, or the first nodes N11 and N12 of the second pixel circuit 120 may be electrically connected to another pixel circuit through another potential adjustment transistor; at this time, a potential difference between the first nodes N11 and N12 of the second pixel circuit 120 and the second node N2 of the second pixel circuit 120 may be reduced, so that the driving transistor T of the second pixel circuit 120 may drive the light emitting module 12 thereof to emit light stably. Accordingly, as shown in FIG. 6, when the first pixel circuit and the second pixel circuit electrically connected to a same potential adjustment module 20 are a same pixel circuit, if the third scan signal S3 controls the potential adjustment transistor M3 of the potential adjustment module 20 to be turned on, then a signal of the second node N2 of the pixel circuit 10 is transmitted to the first nodes N11 and N12 of the pixel circuit 10 through the turned-on potential adjustment transistor M3, so that potentials of the first nodes N11 and N12 of the pixel circuit 10 are kept consistent with a potential of the second node N2 of the pixel circuit 10, and thus the driving transistor T of the pixel circuit 10 drives the light emitting module 12 thereof to emit light stably.

When the potential adjustment module 20 includes the potential adjustment transistor M3, an aspect ratio of the potential adjustment transistor M3 may be less than an aspect ratio of the first transistor (M11, M12); or, the aspect ratio of the potential adjustment transistor M3 may be less than an aspect ratio of the second transistor (M21, M22); or, the aspect ratio of the potential adjustment transistor M3 may be simultaneously less than both the aspect ratio of the first transistor (M11, M12) and the aspect ratio of the second transistor (M21, M22). As such, when the potential adjustment transistor M3 is in a turned-off state, the potential adjustment transistor M3 may have a relatively small leakage current, and the potentials of the first nodes N11 and N12 and the second node N2 electrically connected to the potential adjustment transistor M3 may be ensured to be stable.

Figure 8:
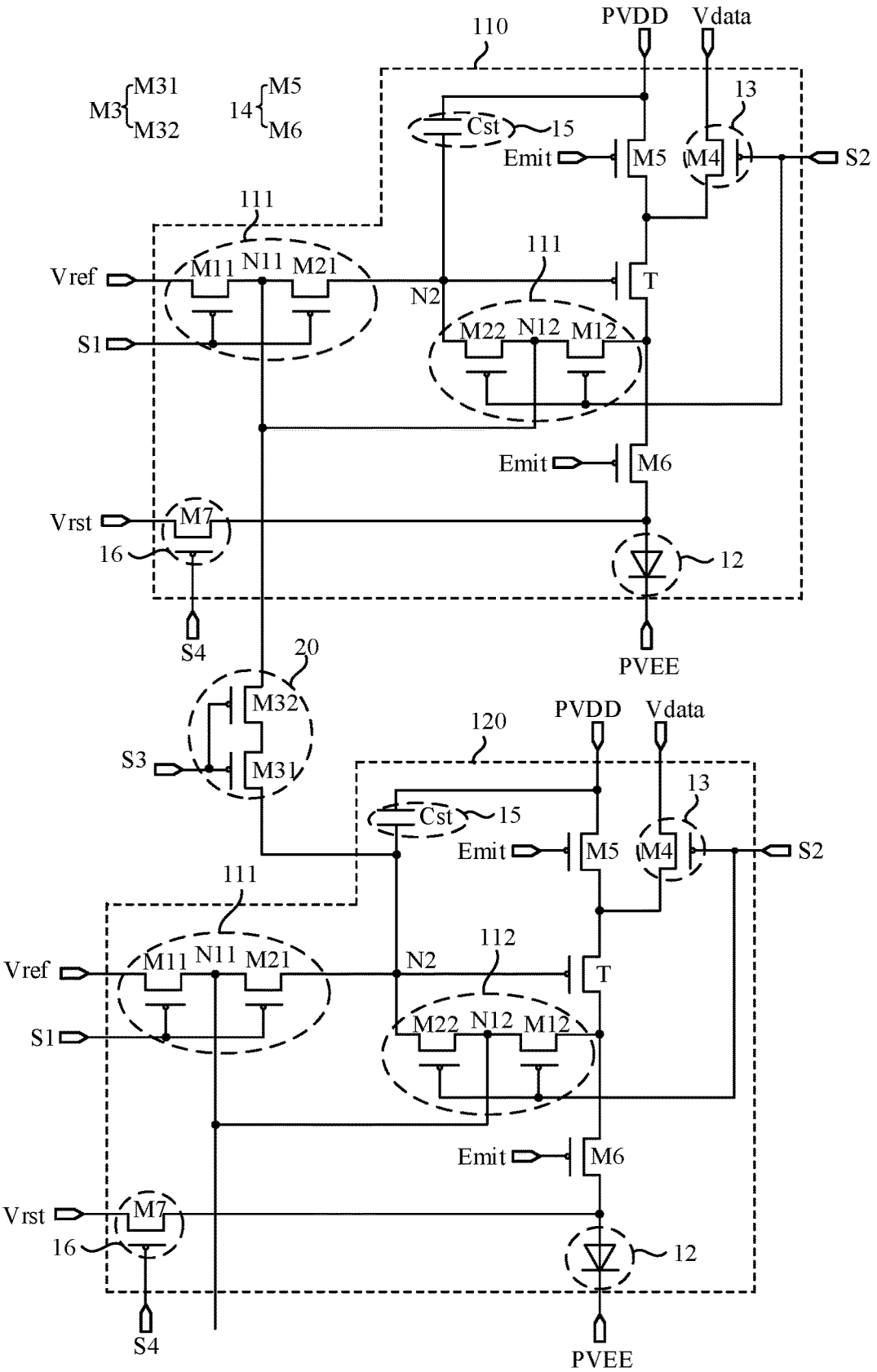
FIG. 8 is a schematic structural view of yet another pixel circuit in a display panel provided by an embodiment of the present disclosure.

In addition, as shown in FIG. 8, when the potential adjustment module 20 includes the potential adjustment transistor M3, the potential adjustment transistor M3 may include a double-gate transistor; the double-gate transistor includes a third transistor M31 and a fourth transistor M32. A first electrode of the third transistor M31 is electrically connected to the second node N2 of the second pixel circuit 120, a second electrode of the third transistor M31 is electrically connected to a first electrode of the fourth transistor M32, a second electrode of the fourth transistor M32 is electrically connected to the first nodes of the first pixel circuit 110; and a gate electrode of the third transistor M31 and a gate electrode of the fourth transistor M32 both receive the third scan signal S3. As such, a leakage current of the potential adjustment transistor M3 may be reduced, and the potentials of the first nodes N11 and N12 and the second node N2 electrically connected to the potential adjustment transistor M3 can be ensured to be stable.

Moreover, as shown in any one of FIGS. 6 to 8, each pixel circuit (10, 110, or 120) may further include a data writing module 13, a light emitting control module 14, a storage module 15, an anode reset module 16, and the like. The data writing module 13 may write a data signal Vdata into the second node N2 in a data writing phase. The light emitting control module 14 may control, in the light emitting phase, the driving current provided by the driving transistor T to flow into the light emitting module 12. The storage module 15 may maintain the potential of the second node N2 in the light emitting phase. The anode reset module 16 may reset a drive current input end of the light emitting module 12 in a reset phase.

Exemplarily, the data writing module 13 may include a data writing transistor M4, a first electrode of the data writing transistor M4 receives a data signal Vdata, a second electrode of the data writing transistor M4 is electrically connected to a first electrode of the driving transistor T, a gate electrode of the data writing transistor M4 receives a second scan signal. In the data writing phase, the second scan signal S2 may control the data writing transistor M4 to be turned on, so that the data signal Vdata may be written into the gate electrode of the driving transistor T, namely, the second node N2, through the turned-on data writing transistor M4; while in other phases, this second scan signal S2 may control the data writing transistor M4 to be turned off. The light emitting control module 14 may include light emitting control transistors M5 and M6, the light emitting control transistors M5 and M6 are disposed in series between a first power signal end PVDD and the light emitting module 12, and gate electrodes of the light emitting control transistors M5 and M6 receive a light emitting control signal Emit; the light emitting control signal Emit may control the light emitting control transistors M5 and M6 to be turned on in the light emitting phase, so that the driving current provided by the driving transistor T may flow into the light emitting module 12; while in other phases, the light emitting control signal Emit may control the light emitting control transistors M5 and M6 to be in the turned-off state. The storage module 15 may include a storage capacitor Cst, the storage capacitor Cst has one end electrically connected to the first power signal PVDD and the other end electrically connected to the gate electrode of the driving transistor T at the second node N2. The anode reset module 16 may include a reset transistor M7, a first electrode of the reset transistor M7 receives a reset signal Vrst, a second electrode of the reset transistor M7 is electrically connected to a driving current input end of the light emitting module 12, and a gate electrode of the reset transistor M7 receives a fourth scan signal S4, The fourth scan signal S4 may control the reset transistor M7 to be turned on in the anode reset phase, so that the reset signal Vrst may be written into the driving signal input end of the light emitting module 12 through the turned-on reset transistor M7. For example, when the light emitting module 12 is an organic light-emitting diode, the second electrode of the reset transistor M7 is electrically connected to an anode of the organic light-emitting diode, so that the reset transistor M7 may transmit the reset signal Vrst to the anode of the organic light-emitting diode in the anode reset phase, so as to reset the anode of the organic light-emitting diode; while in other phases, the fourth scan signal S4 controls the reset transistor M7 to be in the turned-off state. Meanwhile, a cathode of the organic light-emitting diode is electrically connected to a second power signal PVEE, and the second power signal PVEE is different from the first power signal PVDD, so as to form a conductive circuit loop between the first power signal PVDD and the second power signal PVEE in the light emitting phase, and the driving current provided by the driving transistor T flows into the organic light-emitting diode to drive the organic light-emitting diode to emit light. The fourth scan signal S4 may be the same as the first scan signal S1 received by the gate electrode of the first transistor M11 and the gate electrode of the second transistor M21 in the first switching module 111, or, the fourth scan signal S4 may also be the same as the second scan signal S2 received by the gate electrode of the data writing transistor M4, and the reset signal Vrst may be the same as the initialization signal Vref.

It should be noted that the pixel circuits shown in FIGS. 6 to 8 are merely structure diagrams of exemplary pixel circuits of the embodiments of the present disclosure; and on the premise that the technical schemes of the embodiments of the present disclosure may be realized and the beneficial effects of the embodiments of the present disclosure may be achieved, the structure of the pixel circuits is not limited by the embodiments of the present disclosure. For ease of description, the embodiments of the present disclosure are exemplarily explained in the embodiments of the present disclosure by using the pixel circuits in FIGS. 6 to 8 as an example. Moreover, each transistor in the pixel circuits shown in FIGS. 6 to 8 is a P-type transistor, and each transistor in the pixel circuits in the embodiments of the present disclosure may also be an N-type transistor, which is not limited in the embodiments of the present disclosure.

When each pixel circuit of the display panel further includes the data writing module, and the data writing module may write the data signal into the second node of the pixel circuit in the data writing phase, the third scan signal received by the potential adjustment transistor electrically connected to at least one first pixel circuit in an $i^{th}$ row may control the potential adjustment transistor to be turned on after the data writing phase of the at least one first pixel circuit in the $i^{th}$ row. At this time, the first pixel circuit and the second pixel circuit electrically connected to a same potential adjustment transistor may be a same pixel circuit; or, the first pixel circuit and the second pixel circuit electrically connected to a same potential adjustment transistor are two different pixel circuits located in a same row; or, the first pixel circuit and the second pixel circuit electrically connected to a same potential adjustment transistor are a pixel circuit located in the $i^{th}$ row and a pixel circuit located in an $(i+)^{th}$ row, respectively; and i is an integer greater than or equal to 1.

Figure 9:
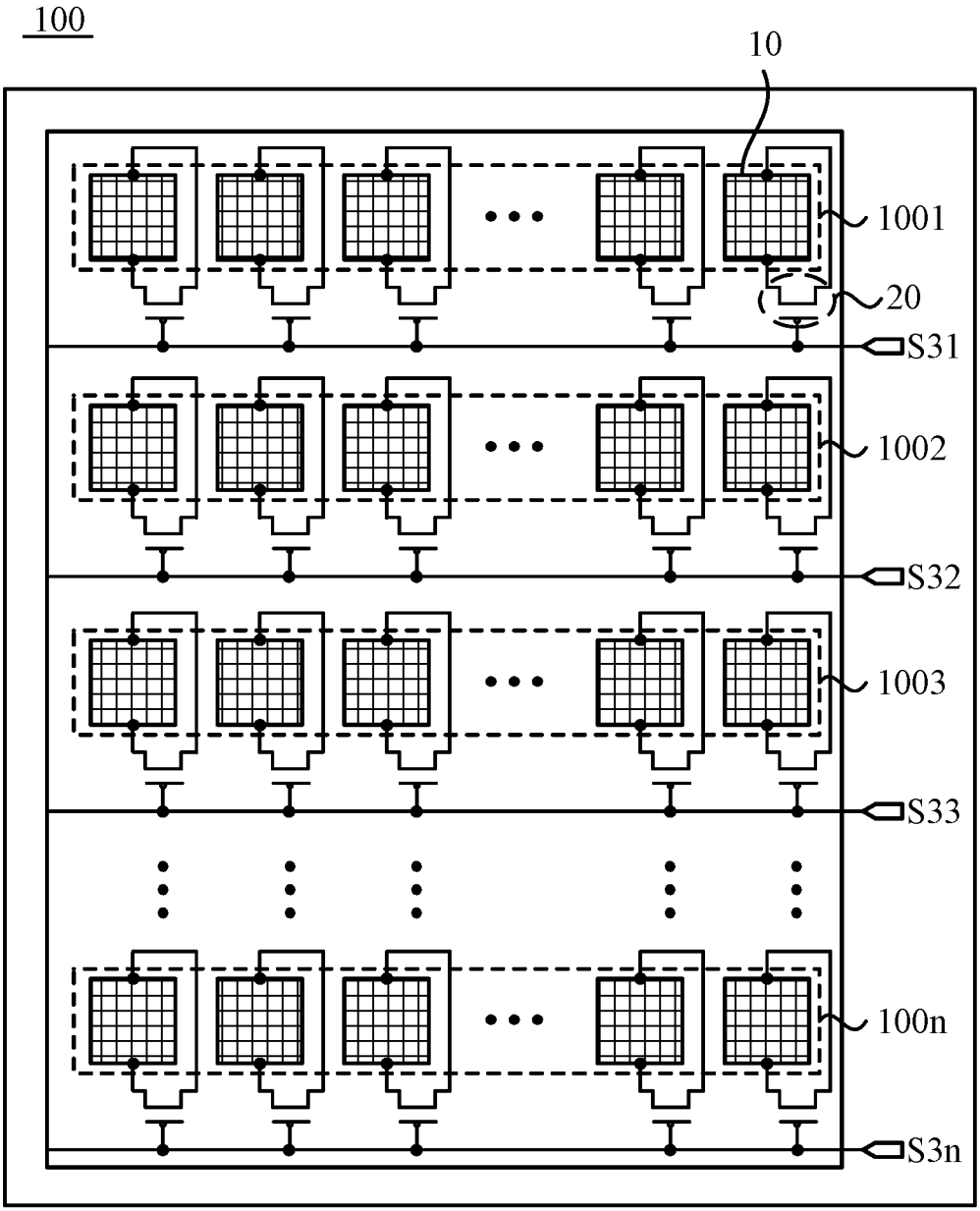
FIG. 9 is a schematic structural view of yet another display panel provided by an embodiment of the present disclosure.
Figure 10:
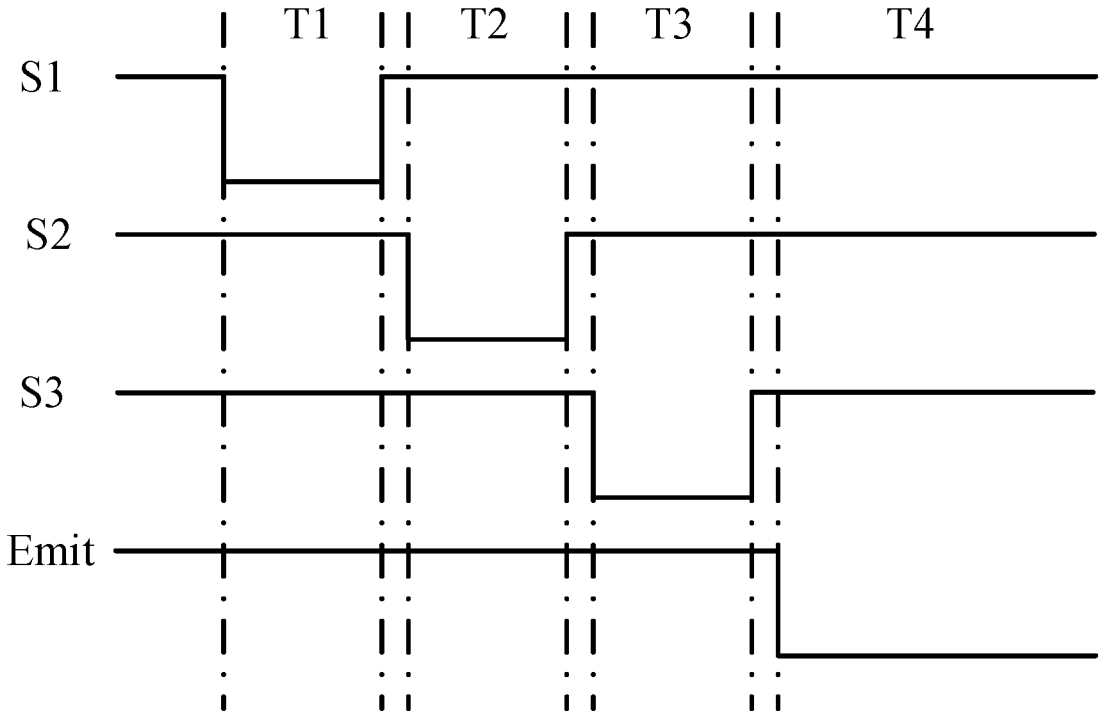
FIG. 10 is a timing view of a pixel circuit provided by an embodiment of the present disclosure.

Illustratively, FIG. 9 is a schematic structural view of yet another display panel provided by an embodiment of the present disclosure, and FIG. 10 is a timing view of a pixel circuit provided by an embodiment of the present disclosure. As shown in conjunction with FIG. 6, FIG. 9 and FIG. 10, when the first pixel circuit and the second pixel circuit electrically connected to a same potential adjustment transistor M3 are a same pixel circuit 10, the pixel circuit 10 may include an initialization phase T1, a data writing phase T2, a potential adjustment phase T3 and a light emitting phase T4. In the initialization phase T1, the first scan signal S1 jumps to the low level VGL, the second scan signal S2, the light emitting control signal Emit and the third scan signal S3 are all the high level VGH, and the first transistor M11 and the second transistor M12 of the first switching module 111 are turned on. Meanwhile, the fourth scan signal S4 is the same as the first scan signal S1, and the reset transistor M7 is also turned on at this time; while other transistors are in the turned-off state, and the reset signal Vrst is the same as the initialization signal Vref, so that the initialization signal Vref is transmitted to the gate electrode of the driving transistor T and the driving current input end of the light emitting module 12 respectively, so as to initialize the driving transistor T and the light emitting module 12. In the data writing phase T2, the first scan signal S1 jumps to the high level VGH, so that a potential of the first node N11 is pulled up, the second scan signal S2 jumps to the low level VGL, the light emitting control signal Emit and the third scan signal S3 are kept at the high level VGH, and the data writing transistor M4 of the data writing module 13 and the first transistor M12 and the second transistor M22 of the second switching module 112 are all turned on, while other transistors are in the turned-off state, so that the threshold voltage of the driving transistor T is compensated for the gate electrode of the driving transistor T, and the data signal Vdata is written into the gate electrode of the driving transistor T. After the data writing phase T2 ends, the first scan signal S1 is kept at the high level VGH, so that the first node N11 is kept in a pulled-up state, the second scan signal S2 jumps to the high level VGH, so that the first node N12 is also pulled up, and at this time, a relatively large potential difference exists between the first node N11 and the second node N2 and between the first node N12 and the second node N2. After the potential adjustment phase T3 is entered, the third scan signal S3 jumps to the low level VGL, so that the potential adjustment transistor M3 is turned on, and the signal of the second node N2 of the pixel circuit 10 is written into the first node N11 and the first node N12 through the turned-on potential adjustment transistor M3. At the end of the potential adjustment phase T3, the potentials of the first node N11 and the first node N12 are kept to be consistent with the potential of the second node N2. When the light emitting phase T4 is entered, the light emitting control signal Emit controls the light emitting control transistors M5 and M6 to be turned on, so that the driving current, which is generated by the driving transistor T according to the potential of the second node N2, flows into the light emitting module 11, and the light emitting module 11 emits light. Meanwhile, after the potential adjustment phase T3 ends and before the light emitting phase T4 starts, the potentials of the first node N11 and the first node N12 are kept to be consistent with the potential of the second node N2, so that the leakage currents generated by the potential difference between the first node N11 and the second node N2 and by the potential difference between the N12 and the second node N2 are reduced, and the potential of the second node N2 is ensured to be stable, therefore, the driving transistor T may provide a stable driving current in the light emitting phase to the light emitting module 12, and the light emitting module 12 emits light stably.

As such, the potential adjustment phase T4 of the pixel circuit 10 is set after the data writing phase of the pixel circuit 10, compared with the scheme in which the potential adjustment phase T4 is set before the data writing phase of the pixel circuit 10, the phenomenon that the potential of the first node N12 is pulled up due to a sudden jump of the second scan signal S2 after the data writing phase, so as to cause a relatively large potential difference between the first node N12 and the second node N2, thus affecting the potential of the second node N2 in the light emitting phase can be prevented.

In addition, pixel circuits located in a same row may have a same initialization phase T1, data writing phase T2, potential adjustment phase T3, and light emitting phase T4. Illustratively, as shown in FIG. 9, each pixel circuit 10 of a first row pixel circuit 1001 has the same initialization phase T1, data writing phase T2, potential adjustment phase T3, and light emitting phase T4; each pixel circuit 10 of a second row pixel circuit 1002 has the same initialization phase T1, data writing phase T2, potential adjustment phase T3, and light emitting phase T4; and each pixel circuit 10 of a third row pixel circuits 1003 has the same initialization phase T1, data writing phase T2, potential adjustment phase T3, and light emitting phase T4, . . . and so on, each pixel circuit 10 of an $n^{th}$ row pixel circuits 100*n* has the same initialization phase T1, data writing phase T2, potential adjustment phase T3, and light emitting phase T4. As such, the driving timing shown in FIG. 10 is also suitable for the case that the first pixel circuit and the second pixel circuit electrically connected to the same potential adjustment transistor M3 are different pixel circuits located in the same row.

Correspondingly, as shown in FIG. 9, when the pixel circuits located in the same row may have the same initialization phase T1, the same data writing phase T2, the same potential adjustment phase T3 and the same light emitting phase T4, gate electrodes of potential adjustment transistors of the potential adjustment modules 20 electrically connected to the pixel circuits 10 located in the same row may be electrically connected to a same scan signal line, and receive a third scan signal transmitted by this scan signal line. For example, gate electrodes of potential adjustment transistors of potential adjustment modules 20 electrically connected to the first row pixel circuit 1001 receive a third scan signal S31 transmitted by a same scan signal line, gate electrodes of potential adjustment transistors of potential adjustment modules 20 electrically connected to the second row pixel circuit 1002 receive a third scan signal S32 transmitted by a same scan signal line, gate electrodes of potential adjustment transistors of potential adjustment modules 20 electrically connected to the third row pixel circuits 1003 receive a third scan signal S33 transmitted by a same scan signal line, . . . , and so on, gate electrodes of potential adjustment transistors of potential adjustment modules 20 electrically connected to the $n^{th}$ row pixel circuit 100*n* receive a third scan signal S3*n* transmitted by a same scan signal line.

Figure 11:
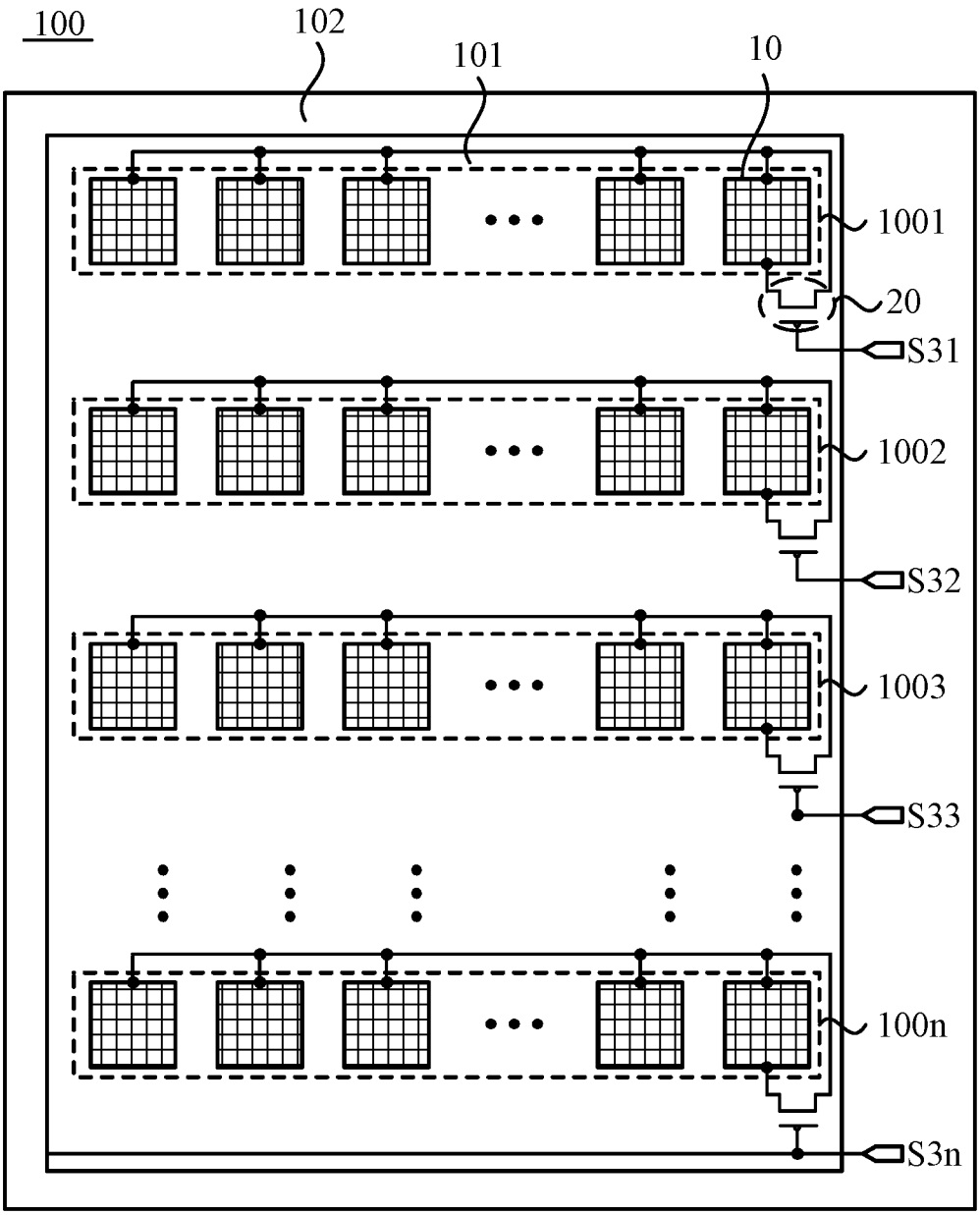
FIG. 11 is a schematic structural view of another display panel provided by an embodiment of the present disclosure.

Illustratively, as shown in FIG. 11, first nodes of pixel circuits located in a same row are electrically connected to the second node of one of the pixel circuits in this row through the potential adjustment transistor of a same potential adjustment module 20. For example, first nodes of pixel circuits 10 of the first row pixel circuit 1001 are electrically connected to the second node of a rightmost pixel circuit 10 of the first row pixel circuit 1001 through the potential adjustment transistor of a same potential adjustment module 20; at this time, in the potential adjustment phase T3 of the first row pixel circuit 1001, a potential of the second node of the rightmost pixel circuit 10 of the first row pixel circuit 1001 may be transmitted to first nodes of the pixel circuits of the first row pixel circuit 1001, and the potential of the second node of the rightmost pixel circuit 10 is also transmitted to the first node of the rightmost pixel circuit, so as to control the potential difference between the first node and the second node of each pixel circuit of the first row pixel circuit 1001 to be within the preset potential difference range in the light emitting phase of the first row pixel circuit 1001.

Figure 12:
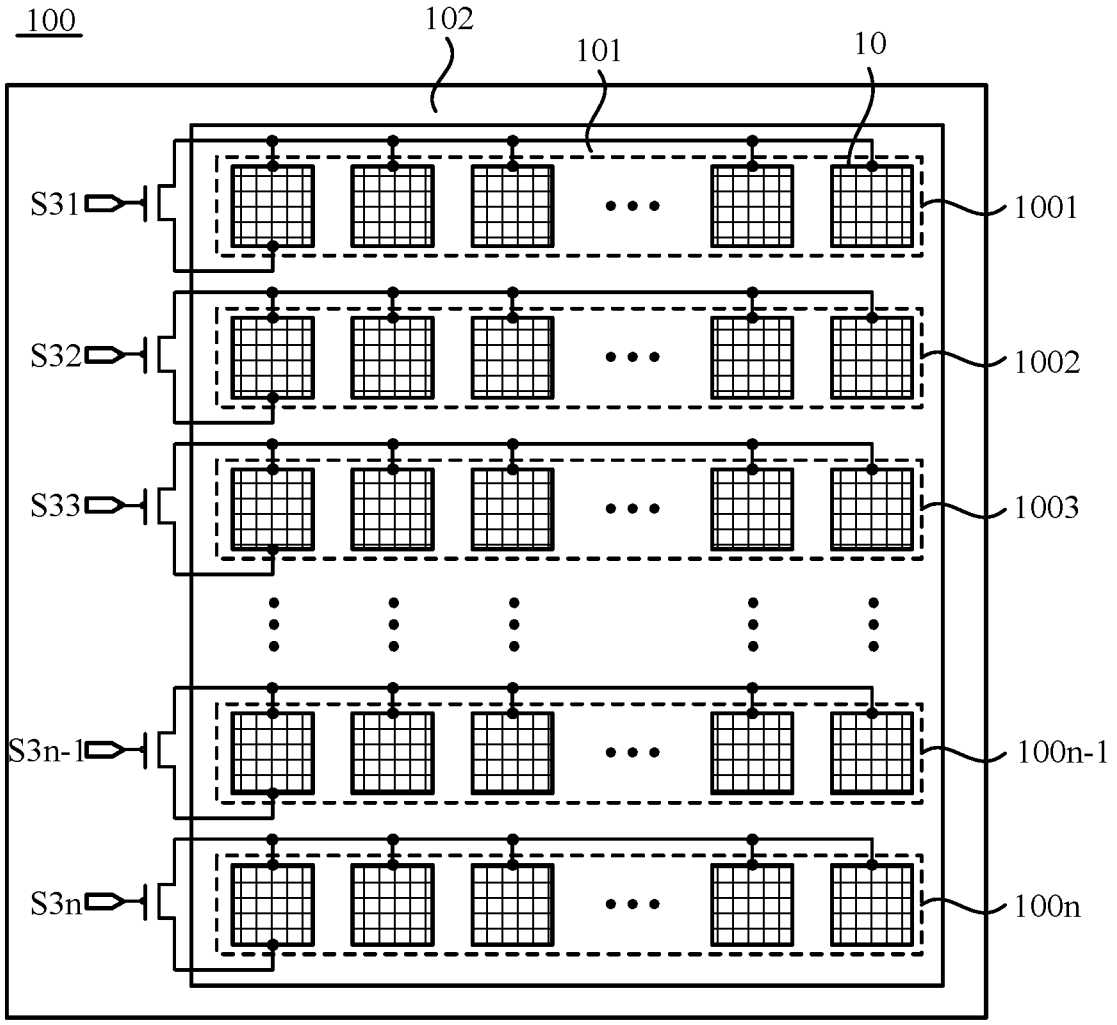
FIG. 12 is a schematic structural view of yet another display panel provided by an embodiment of the present disclosure.

It should be noted that FIG. 11 is merely an exemplary drawing of the embodiments of the present disclosure, in FIG. 11, the display panel 100 includes a display region 101 and a non-display region 102, and each pixel circuit 10 and each potential adjustment transistor are all disposed in the display region 101; however, in other embodiments of the present disclosure, only the pixel circuits may be disposed in the display region, while the potential adjustment transistors may be disposed in the non-display region (as shown in FIG. 12).

Moreover, when the first pixel circuit and the second pixel circuit electrically connected to a same potential adjustment transistor are a pixel circuit located in an $i^{th}$ row and a pixel circuit located in an $(i+1)^{th}$ row, respectively, pixel circuits located in the $(i+1)^{th}$ row may be electrically connected to pixel circuits located in the $i^{th}$ row in a one-to-one correspondence manner.

Figure 13:
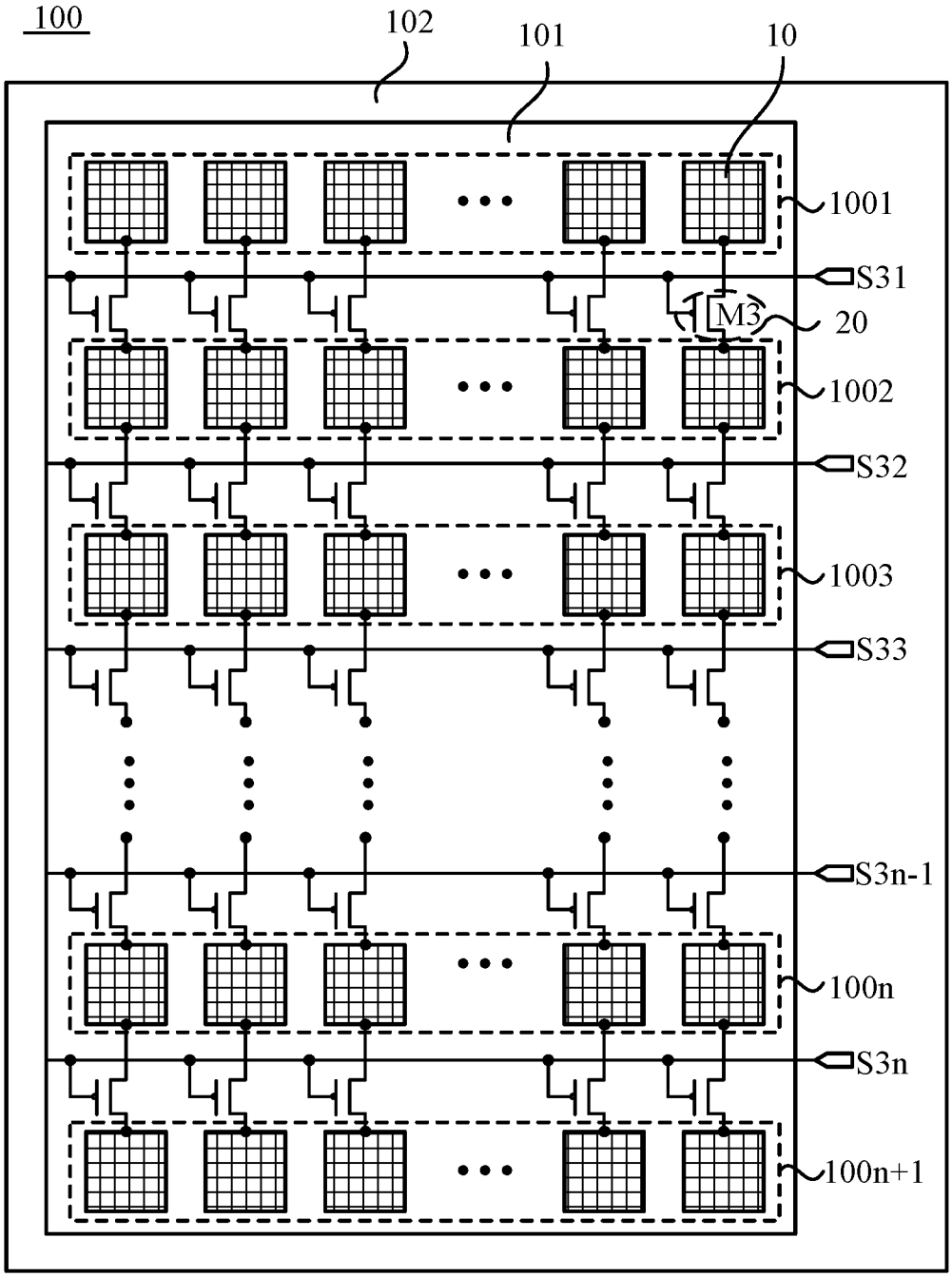
FIG. 13 is a schematic structural view of yet another display panel provided by an embodiment of the present disclosure.

Illustratively, FIG. 13 is a schematic structural view of yet another display panel provided by an embodiment of the present disclosure. The same parts of FIG. 13 and FIG. 9 may be referred to the above description of FIG. 9, FIG. 10 and FIG. 6, which will not be described in detail herein, and only the differences between FIG. 13 and FIG. 9 will be exemplarily described here. In conjunction with FIG. 7, FIG. 10 and FIG. 13, that the pixel circuit 110 is the first pixel circuit located in the $i^{th}$ row and the pixel circuit 120 is the second pixel circuit located in the $(i+1)^{th}$ row is used as an example, the first nodes N11 and N12 of the first pixel circuit 110 are electrically connected to the second node N2 of the second pixel circuit 120 through the potential adjustment transistor M3; after the data writing phase T2 of the first pixel circuit 110, the potential adjustment phase T3 of the first pixel circuit 110 is entered, and the third scan signal S3 jumps to the low level, so that the potential of the second node N2 of the second pixel circuit 120 may be written into the first nodes N11 and N12 of the first pixel circuit 110 through the turned-on potential adjustment transistor M3, and after the potential adjustment phase T3 ends, the potential difference between the first nodes N11 and N12 of the first pixel circuit 110 and the second node N2 of the first pixel circuit 110 may be within the preset potential difference range.

Accordingly, when the first pixel circuit and the second pixel circuit electrically connected to a same potential adjustment transistor are a pixel circuit located in the $i^{th}$ row and a pixel circuit located in the $(i+1)^{th}$ row, respectively, one pixel circuit located in the $(i+1)^{th}$ row is electrically connected to one pixel circuit or one row of pixel circuits located in the $i^{th}$ row.

Figure 14:
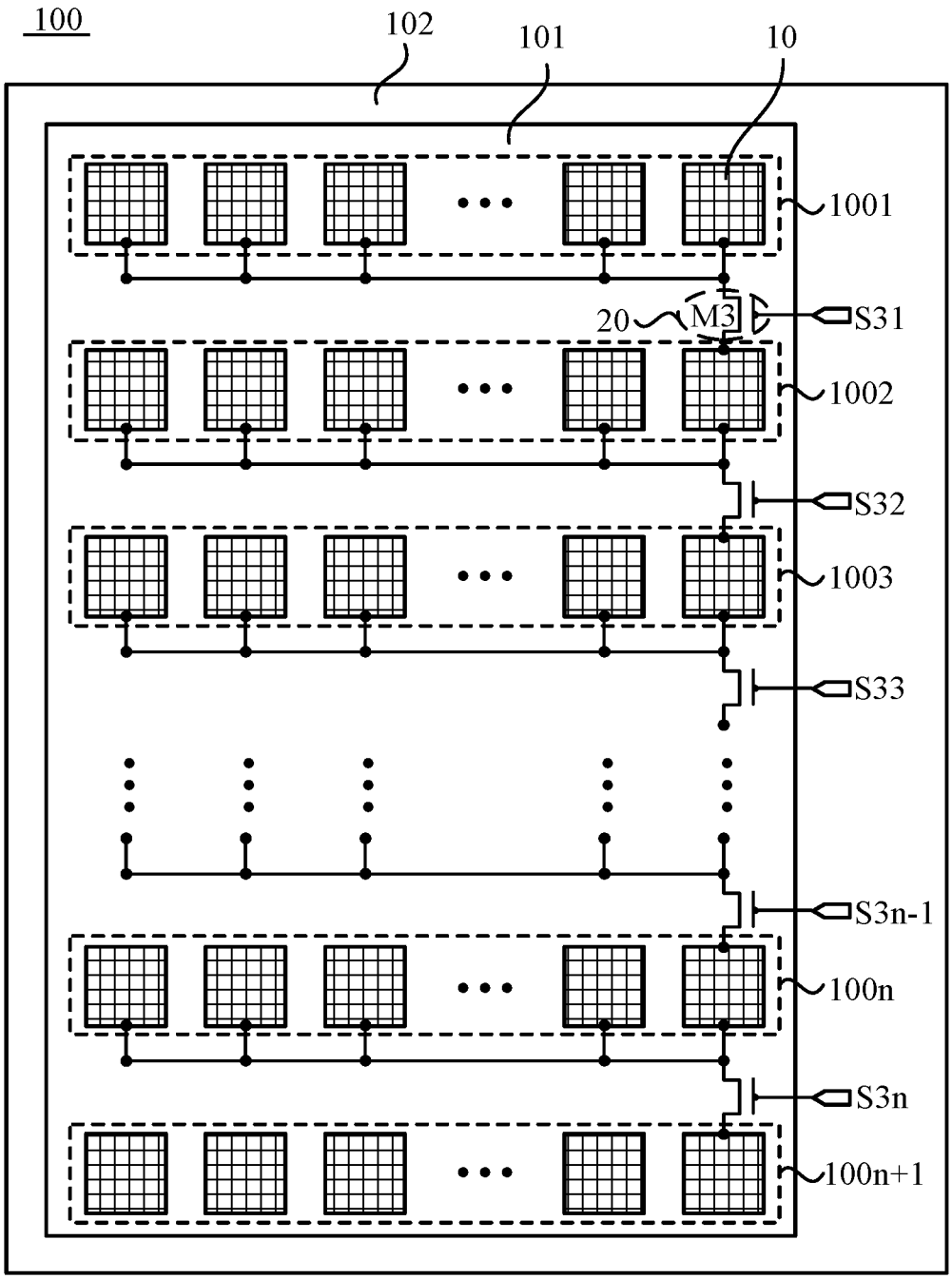
FIG. 14 is a schematic structural view of yet another display panel provided by an embodiment of the present disclosure.

Exemplary, FIG. 14 is a schematic structural view of yet another display panel provided by an embodiment of the present disclosure. The same parts of FIG. 14 and FIG. 13 may be referred to the above description of FIG. 13, which will not be described in detail herein, and only the differences between FIG. 14 and FIG. 13 will be exemplarily described here. As shown in FIG. 14, when i=1, one pixel circuit of the second row pixel circuit 1002 is electrically connected to all pixel circuits of the first row pixel circuit 1001 through one potential adjustment transistor M3, so that, in the potential adjustment phase, a signal of the second node of the one pixel circuit of the second row pixel circuit 1002 may be transmitted to first nodes of the all pixel circuits of the first row pixel circuit 1001, and thus, in the light emitting phase of the first row pixel circuit 1001, the potential difference between the first node and the second node of the pixel circuits of the first row pixel circuit 1001 may be within the preset potential difference range.

Figure 15:
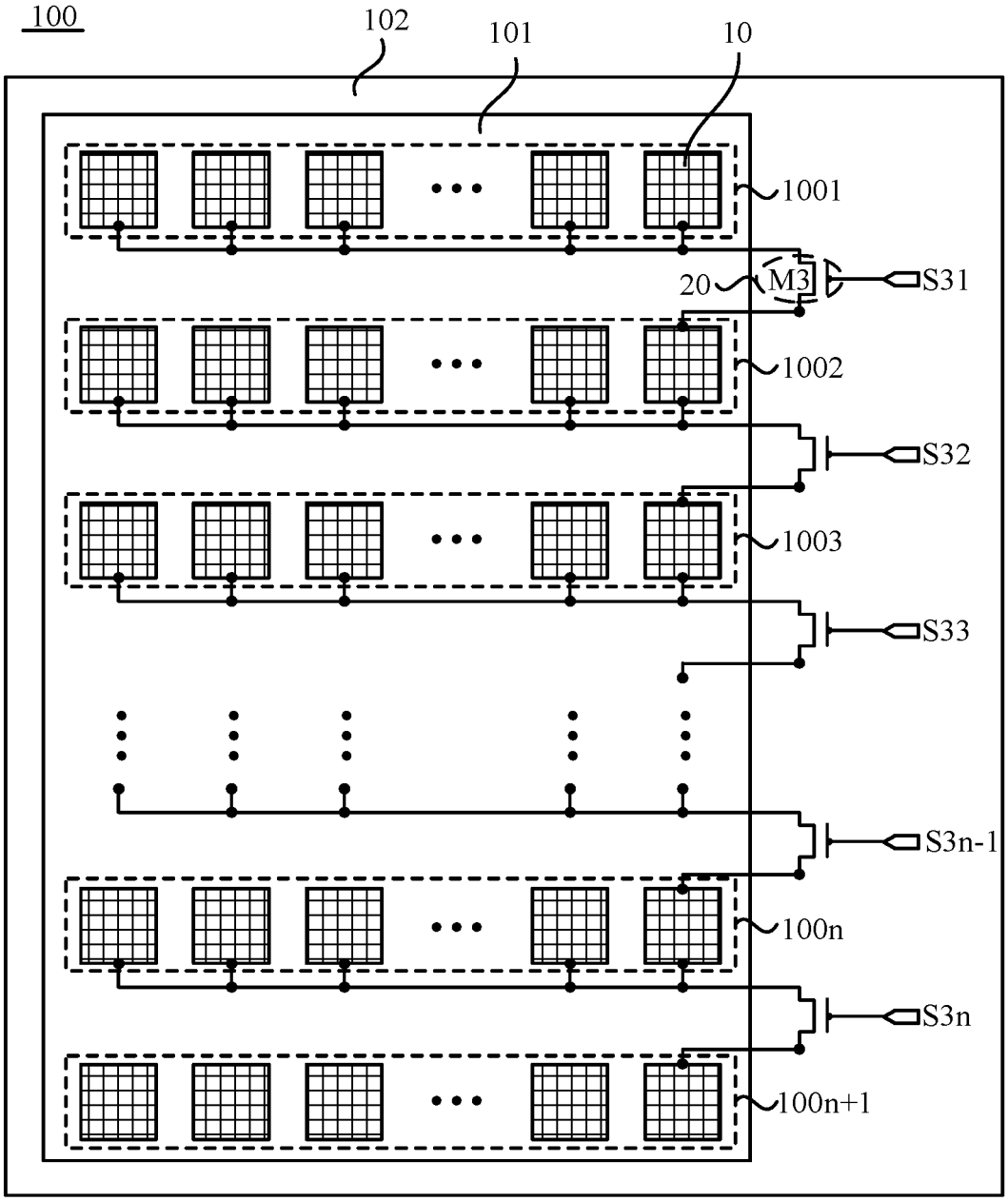
FIG. 15 is a schematic structural view of yet another display panel provided by an embodiment of the present disclosure.

It should be noted that FIG. 14 is merely an exemplary drawing of the embodiments of the present disclosure, in FIG. 14, the display panel 100 includes a display region 101 and a non-display region 102, and each pixel circuit 10 and each potential adjustment transistor are all disposed in the display region 101. However, in other embodiments of the present disclosure, only the pixel circuits may be disposed in the display region, and the potential adjustment transistors may be disposed in the non-display region (as shown in FIG. 15).

For the case that the first pixel circuit and the second pixel circuit electrically connected to the same potential adjustment transistor are the pixel circuit located in the $i^{th}$ row and the pixel circuit located in the $(i+1)^{th}$ row, respectively, if the display panel includes (N+1) rows of pixel circuits, pixel circuits located in an $(N+1)^{th}$ row may be virtual pixel circuits in which the light emitting modules do not emit light.

Illustratively, as shown in FIG. 13, when the display panel 100 includes (N+1) rows of pixel circuits, and N is an integer greater than or equal to 1, in each pixel circuit 10 located in first N rows, the driving transistor is configured to provide the driving current for the respective light emitting module and drive the respective light emitting module to emit light; in each pixel circuit 10 located in the $(N+1)^{th}$ row, the driving transistor is configured to provide the driving current for the respective light emitting module, and the respective light emitting module does not emit light. First nodes of pixel circuits of the first row pixel circuit 1001 may be electrically connected to second nodes of pixel circuits of the second row pixel circuit 1002 in a one-to-one correspondence through a respective potential adjustment transistor M3, so that, in the potential adjustment phase of the first row pixel circuit 1001, signals of the second nodes of the pixel circuits of the second row pixel circuit 1002 may be transmitted to the first nodes of the pixel circuits of the first row pixel circuit 1001 in the one-to-one correspondence. First nodes of pixel circuits of the second row pixel circuit 1002 may be electrically connected to second nodes of pixel circuits of the third row pixel circuit 1003 in a one-to-one correspondence through a respective potential adjustment transistor M3, so that, in the potential adjustment phase of the second row pixel circuit 1002, signals of the second nodes of the pixel circuits of the third row pixel circuit 1003 may be transmitted to the first nodes of the pixel circuits of the second row pixel circuit 1002 in the one-to-one correspondence; . . . and so on, first nodes of pixel circuits of the $N^{th}$ row pixel circuit 100*n* may be electrically connected to second nodes of pixel circuits of the $(N+1)^{th}$ row pixel circuit 100*n*+1 in a one-to-one correspondence through a respective potential adjustment transistor M3, so that, in the potential adjustment phase of the $N^{th}$ row pixel circuits 100*n*, signals of the second nodes of the pixel circuits of the $(N+1)^{th}$ row pixel circuit 100*n*+1 may be transmitted to the first nodes of the pixel circuits of the $N^{th}$ row pixel circuits 100*n* in the one-to-one correspondence. However, due to the fact that the light emitting modules of the pixel circuits of the $(N+1)^{th}$ row pixel circuit 100*n*+1 do not emit light, potentials of the first nodes of the pixel circuits of the $(N+1)^{th}$ row pixel circuit 100*n*+1 do not need to be adjusted. When each light emitting module of the pixel circuits located in the first N rows includes an organic light-emitting diode, each light emitting module of the pixel circuits of the $(N+1)^{th}$ row pixel circuit 100*n*+1 may not be provided with a respective organic light-emitting diode.

For the case that the first pixel circuit and the second pixel circuit electrically connected to a same potential adjustment transistor are the pixel circuit located in the $i^{th}$ row and the pixel circuit located in the $(i+1)^{th}$ row, respectively, if the display panel includes (N+1) rows of pixel circuits, then the first node of each pixel circuit located in the $(N+1)^{th}$ row may be electrically connected to the second node of one pixel circuit located in the $(N+1)^{th}$ row through a respective potential adjustment module.

Figure 16:
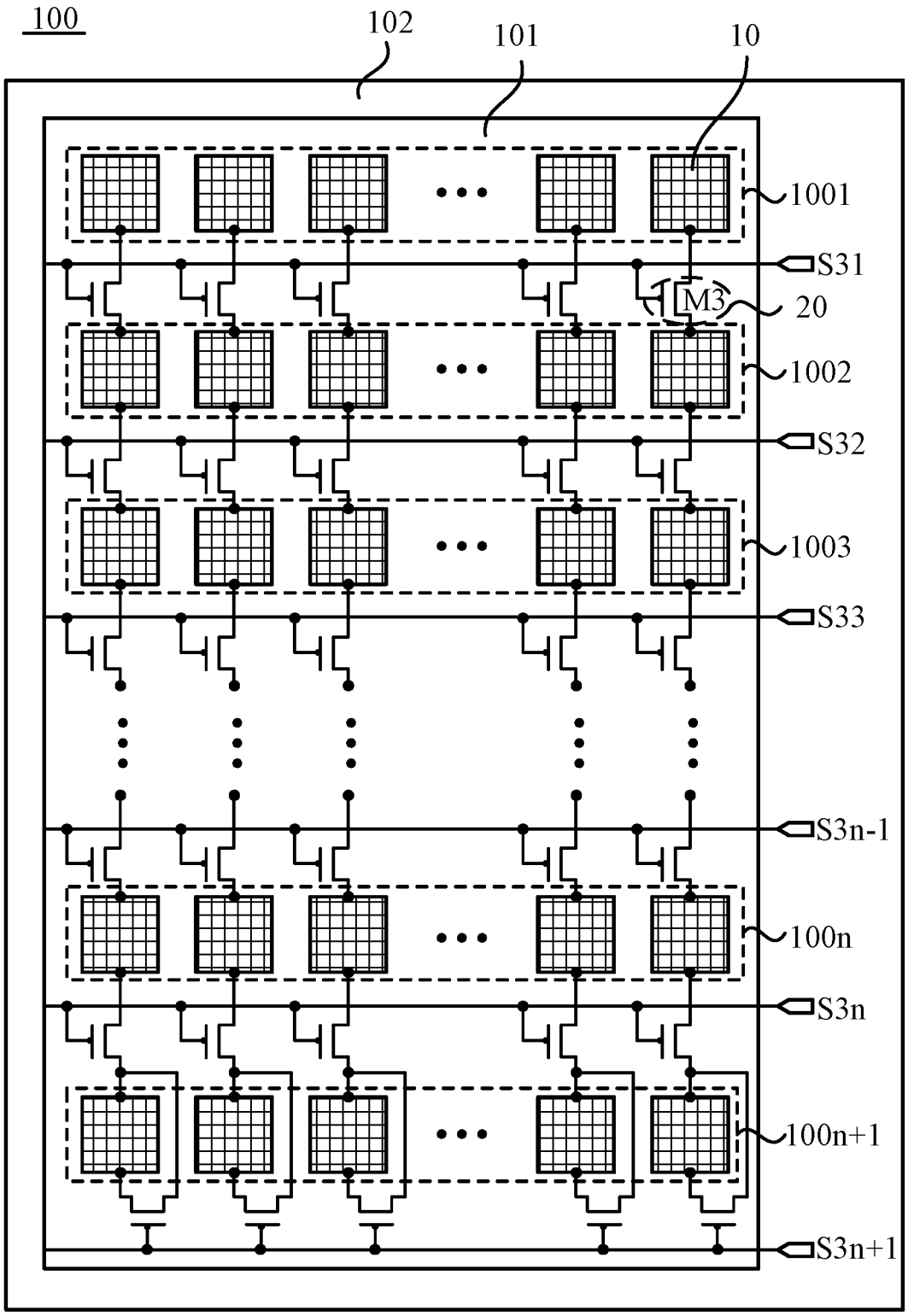
FIG. 16 is a schematic structural view of yet another display panel provided by an embodiment of the present disclosure.

Illustratively, FIG. 16 is a schematic structural view of yet another display panel provided by an embodiment of the present disclosure. The same parts of FIG. 16 and FIG. 13 may be referred to the above description of FIG. 13, which will not be described in detail herein, and only the differences between FIG. 16 and FIG. 13 will be exemplarily described here. As shown in FIG. 16, when the display panel 100 includes (N+1) rows of pixel circuits, and each light emitting module in the (N+1) rows of pixel circuits may emit light under the driving of its own driving transistor, the first nodes of the pixel circuits located in the $(N+1)^{th}$ row are electrically connected to the second nodes of the pixel circuits located in the $(N+1)^{th}$ row through the potential adjustment transistors of the potential adjustment modules, namely, the first node of each pixel circuit of the $(N+1)^{th}$ row pixel circuit 100*n*+1 may be electrically connected to the second node of the each pixel circuit of the $(N+1)^{th}$ row pixel circuit 100*n*+1 through the potential adjustment module. At this time, the potential adjustment phase of the pixel circuits of the $(N+1)^{th}$ row pixel circuits 100*n*+1 is similar to the potential adjustment phase of the pixel circuits shown in FIGS. 9 and 6 described above, for the principles, reference may be made to the description of FIGS. 9 and 6, which will not be described in detail herein.

For the case that the first pixel circuit and the second pixel circuit electrically connected to a same potential adjustment transistor are the pixel circuit located in the $i^{th}$ row and the pixel circuit located in the $(i+1)^{th}$ row, respectively, if the display panel includes (N+1) rows of pixel circuits, then the first node of each pixel circuit located in the $(N+1)^{th}$ row may receive a potential adjustment signal through a respective potential adjustment module.

Figure 17:
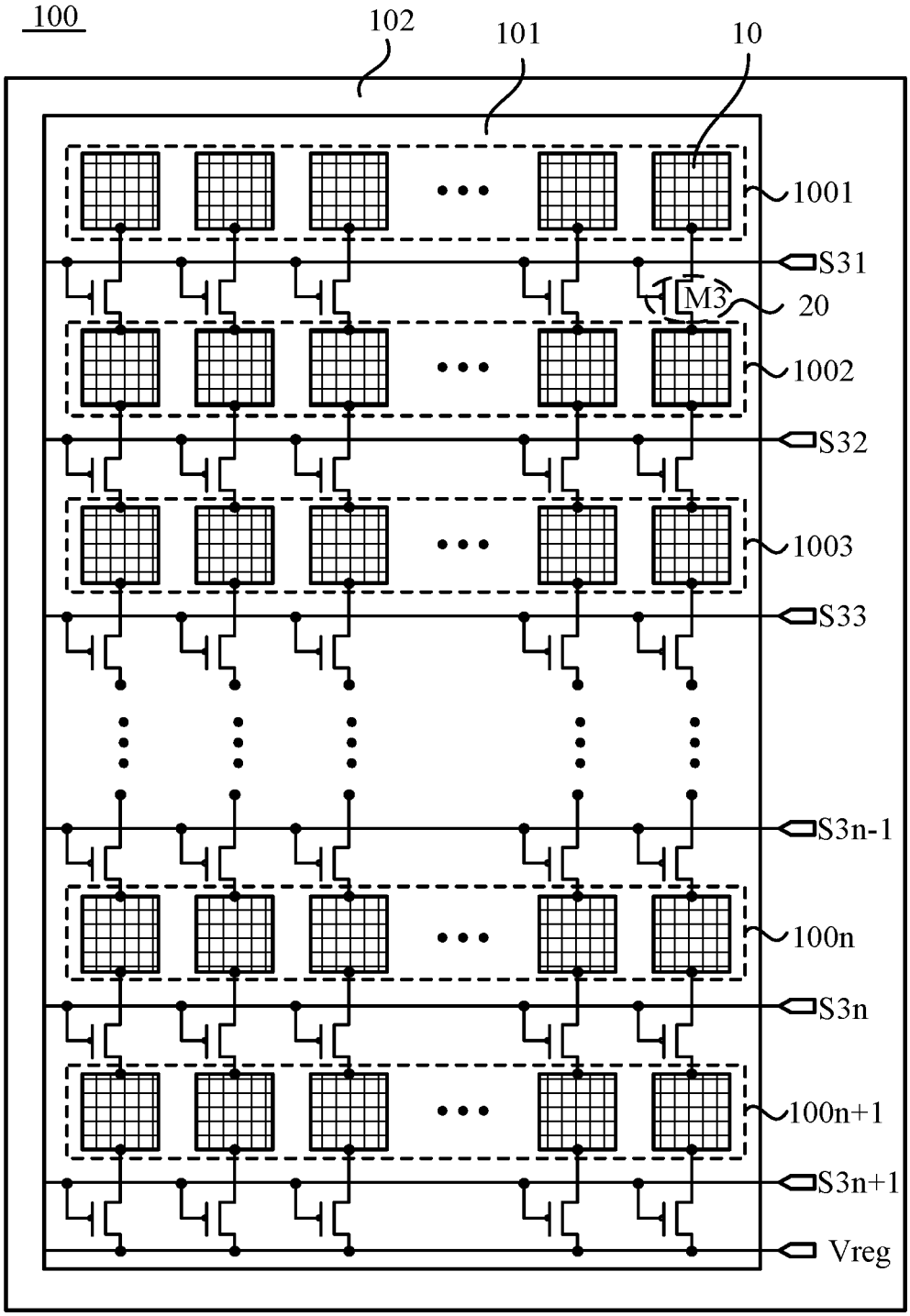
FIG. 17 is a schematic structural view of yet another display panel provided by an embodiment of the present disclosure.

Illustratively, FIG. 17 is a schematic structural view of yet another display panel provided by an embodiment of the present disclosure. The same parts of FIG. 17 and FIG. 16 may be referred to the above description of FIG. 16, which will not be described in detail herein, and only the differences between FIG. 17 and FIG. 16 will be exemplarily described here. As shown in FIG. 17, the first nodes of the pixel circuits located in the $(N+1)^{th}$ row receive a potential adjustment signal Vreg through the potential adjustment modules. As such, in the potential adjustment phase of the $(N+1)^{th}$ row pixel circuit 100$n$+1, the potential adjustment transistors of the potential adjustment modules are turned on, and the $(N+1)^{th}$ row pixel circuit 100$n$+1 receives the potential adjustment signal Vreg through the potential adjustment transistors, so that, in the light emitting phase of the $(N+1)^{th}$ row pixel circuit 100$n$+1, a potential difference between the first node and the second node of each pixel circuit of the $(N+)^{th}$ row pixel circuit 100$n$+1 may be within the preset potential difference range.

A potential adjustment signal transmitted to each pixel circuit of the $(N+1)^{th}$ row pixel circuit 100$n$+1 through the potential adjustment transistor may be a fixed voltage signal or a voltage signal changing along with the change of the potential of the second node of the each pixel circuit of the $(N+1)^{th}$ row pixel circuit 100$n$+1, which is not limited in the embodiments of the present disclosure, on the premise that the potential difference between the first node and the second node of each pixel circuit of the $(N+1)^{th}$ row pixel circuit 100$n$+1 is within the preset potential difference range in the light emitting phase of the $(N+1)^{th}$ row pixel circuit 100$n$+1.

In the embodiments of the present disclosure, pixel circuits in each row of the display panel may sequentially receive a respective scan signal, so that the data writing phase of pixel circuits located in a previous row is before the data writing phase of pixel circuits located in a next row. At this time, when the data writing module of the pixel circuit includes a data writing transistor; a first electrode of the data writing transistor is configured to receive a data signal, a second electrode of the data writing transistor is electrically connected to a first electrode of the driving transistor, a gate electrode of the data writing transistor is configured to receive a second scan signal, and the data writing transistor is configured to be turned on or off under the control of the second scan signal. At this time, the third scan signal received by the potential adjustment transistor electrically connected to at least one pixel circuit located in the $i^{th}$ row and at least one pixel circuit located in the $(i+1)^{th}$ row may be multiplexed as the second scan signal received by the data writing transistor of at least one pixel circuit located in the $(i+1)^{th}$ row, and i is an integer greater than or equal to 1.

Figure 18:
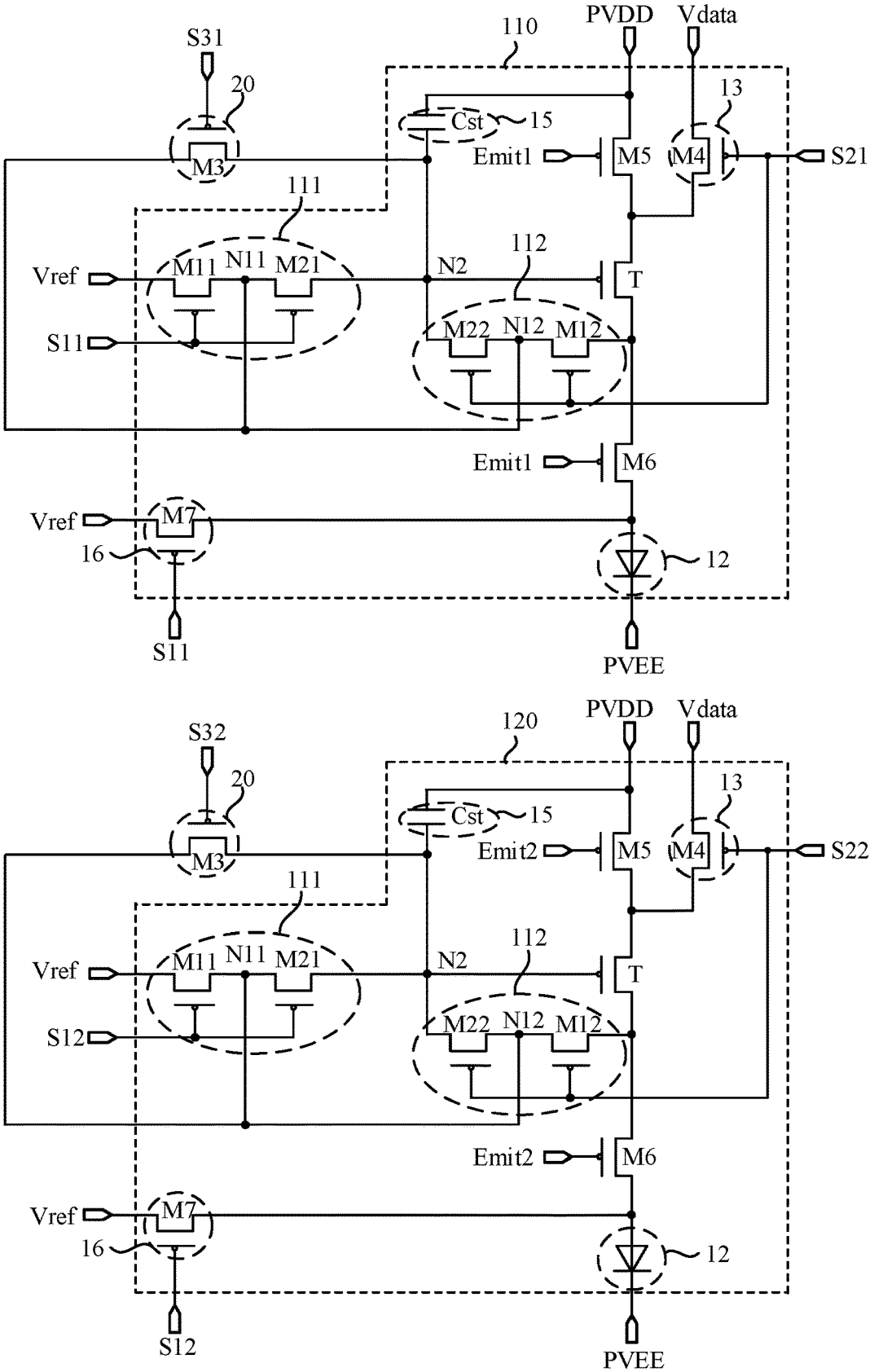
FIG. 18 is a schematic structural view of yet another pixel circuit in a display panel provided by an embodiment of the present disclosure.
Figure 19:
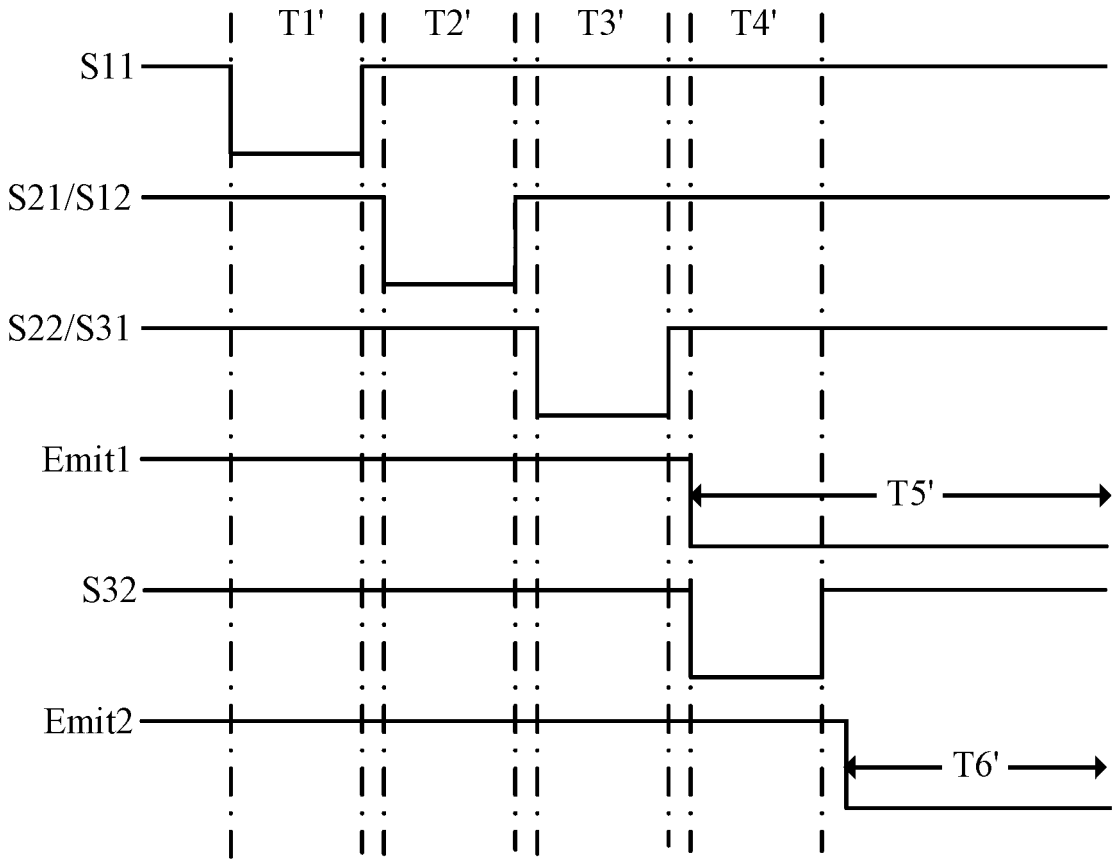
FIG. 19 is a driving timing view of yet another pixel circuit in a display panel provided by an embodiment of the present disclosure.

Illustratively, FIG. 18 is a schematic structural view of yet another pixel circuit in a display panel provided by an embodiment of the present disclosure, FIG. 19 is a driving timing view of yet another pixel circuit in a display panel provided by an embodiment of the present disclosure. As shown in conjunction with FIGS. 18 and 19, that the first pixel circuit and the second pixel circuit electrically connected to a same potential adjustment transistor M3 are a same pixel circuit is used as an example. The pixel circuit 110 is the pixel circuit located in the $i^{th}$ row, and the pixel circuit 120 is the pixel circuit located in the $(i+1)^{th}$ row. In an initialization phase T1' of the pixel circuit 110, a first scan signal S11 received by the pixel circuit 110 is the low level VGL, and a second scan signal S21 received by the pixel circuit 110 is kept at the high level; however, after the initialization phase T1' of the pixel circuit 110 ends, a data writing phase T2' of the pixel circuit 110 and an initialization phase T2' of the pixel circuit 120 are entered at the same time, the first scan signal S11 received by the pixel circuit 110 jumps to the high level, the second scan signal S21 received by the pixel circuit 110 and a first scan signal S12 received by the pixel circuit 120 jump to the low level, and at this time, the second scan signal S21 received by the pixel circuit 110 may be multiplexed as the first scan signal S12 received by the pixel circuit 120. After the data writing phase T2' of the pixel circuit 110 ends, the pixel circuit 110 enters a potential adjustment phase T3', at this time, a third scan signal S31 received by the potential adjustment transistor M3 electrically connected to the pixel circuit 110 may be multiplexed as the second scan signal S22 received by the data writing transistor M4 of the pixel circuit 120. After the potential adjustment phase T3' of the pixel circuit 110 ends, the pixel circuit 110 enters a light emitting phase T4', while the pixel circuit 120 enters a potential adjustment phase T5', the third scan signal S32 received by the potential adjustment transistor M3 electrically connected to the pixel circuit 120 may also be multiplexed as the second scan signal received by a pixel circuit located in an $(i+2)^{th}$ row, and after the potential adjustment phase T4' of the pixel circuit 120 ends, the pixel circuit 110 enters a light emitting phase T6'. As such, the third scan signal received by the potential adjustment transistor M3 electrically connected to the pixel circuit located in the $i^{th}$ row is multiplexed as the second scan signal received by the pixel circuit located in the $(i+1)^{th}$ row, a scan driving circuit for providing a scan signal does not need to be additionally provided for controlling the potential adjustment transistor M3 to be turned on or off, so that the structure of the display panel 100 is simplified.

Figure 20:
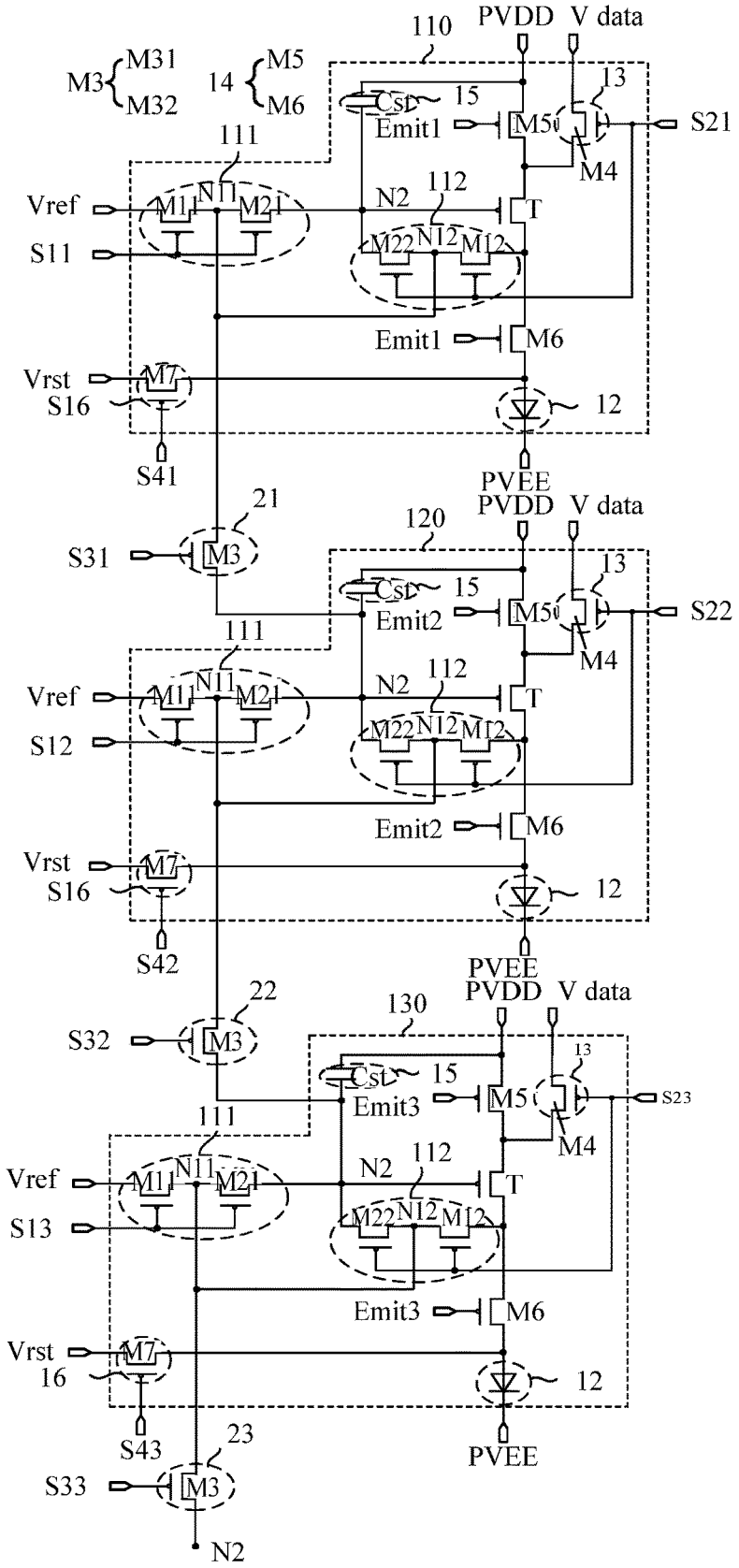
FIG. 20 is a schematic structural view of yet another pixel circuit in a display panel provided by an embodiment of the present disclosure.

Illustratively, FIG. 20 is a schematic structural view of yet another pixel circuit in a display panel provided by an embodiment of the present disclosure. The same parts of FIG. 20 and FIG. 18 may be referred to the above description of FIG. 18, which will not be described in detail herein, and only the differences between FIG. 20 and FIG. 18 will be exemplarily described here. As shown in conjunction with FIGS. 19 and 20, that the first pixel circuit and the second pixel circuit electrically connected to a same potential adjustment transistor M3 are respectively the pixel circuit located in the $i^{th}$ row and the pixel circuit located in the $(i+1)^{th}$ row is used as an example. If the pixel circuit 110 may be the pixel circuit located in the $i^{th}$ row and the pixel circuit 120 may be the pixel circuit located in the $(i+1)^{th}$ row, then the first nodes N11 and N12 of the pixel circuit 110 are electrically connected to the second node N2 of the pixel circuit 120 through the potential adjustment transistor M3 of the potential adjustment module 21. At this time, after the data writing phase T2' of the pixel circuit 110 ends, the data writing phase T3' of the pixel circuit 120 and the potential adjustment phase T3' of the pixel circuit 110 are entered at the same time, and the data writing phase T3' of the pixel circuit 120 and the potential adjustment phase T3' of the pixel circuit 110 may end at the same time. Therefore, the second scan signal S22 received by the pixel circuit 120 may be multiplexed as the third scan signal S31 received by the potential adjustment transistor M3 of the potential adjustment module 21. In this process, a data signal Vdata received by the pixel circuit 120 is written into the second node of the pixel circuit 120, meanwhile, a signal of the second node N2 of the pixel circuit 120 is also transmitted to the first nodes N11 and N12 of the pixel circuit 110 through the turned-on potential adjustment transistor M3, and when the data writing phase of the pixel circuit 120 ends, the potential VN2 of the second node N2 of the pixel circuit 120 is Vdata+Vth, i.e., it may still ensure that the potential VN2 of the second node of the pixel circuit 120 includes a data signal corresponding to a grayscale of the pixel circuit 120 and the threshold voltage of the driving transistor T of the pixel circuit 120. As such, on one hand, a scanning driving circuit does not need to be additionally provided for controlling the potential adjustment transistor M3 to be turned on or off, and the structure of the display panel can be simplified; on the other hand, when the data signal is written into the pixel circuit 120, the potentials of the first nodes N11 and N12 of the pixel circuit 110 do not need to be additionally adjusted, so that the driving manner can be simplified.

With continued reference to FIG. 20, the data writing module 13 of each pixel circuit of the display panel includes a data writing transistor M4, a gate electrode of the data writing transistor M4 is configured to receive the second scan signal, a first electrode of the data writing transistor M4 is configured to receive a data signal Vdata, and a second electrode of the data writing transistor M4 is electrically connected to the first electrode of the driving transistor T, and the data writing transistor M4 may be turned on or off under the control of the second scan signal (S21, S22 and S23). When the first pixel circuit and the second pixel circuit electrically connected to a same potential adjustment module are the pixel circuit located in the $i^{th}$ row and the pixel circuit located in the $(i+1)^{th}$ row, respectively, the third scan signal S31 received by the potential adjustment transistor M3 electrically connected to the first pixel circuit 110 located in the $i^{th}$ row is multiplexed as the second scan signal S23 received by a pixel circuit 130 located in the $(i+2)^{th}$ row; and i is an integer greater than or equal to 1.

Figure 21:
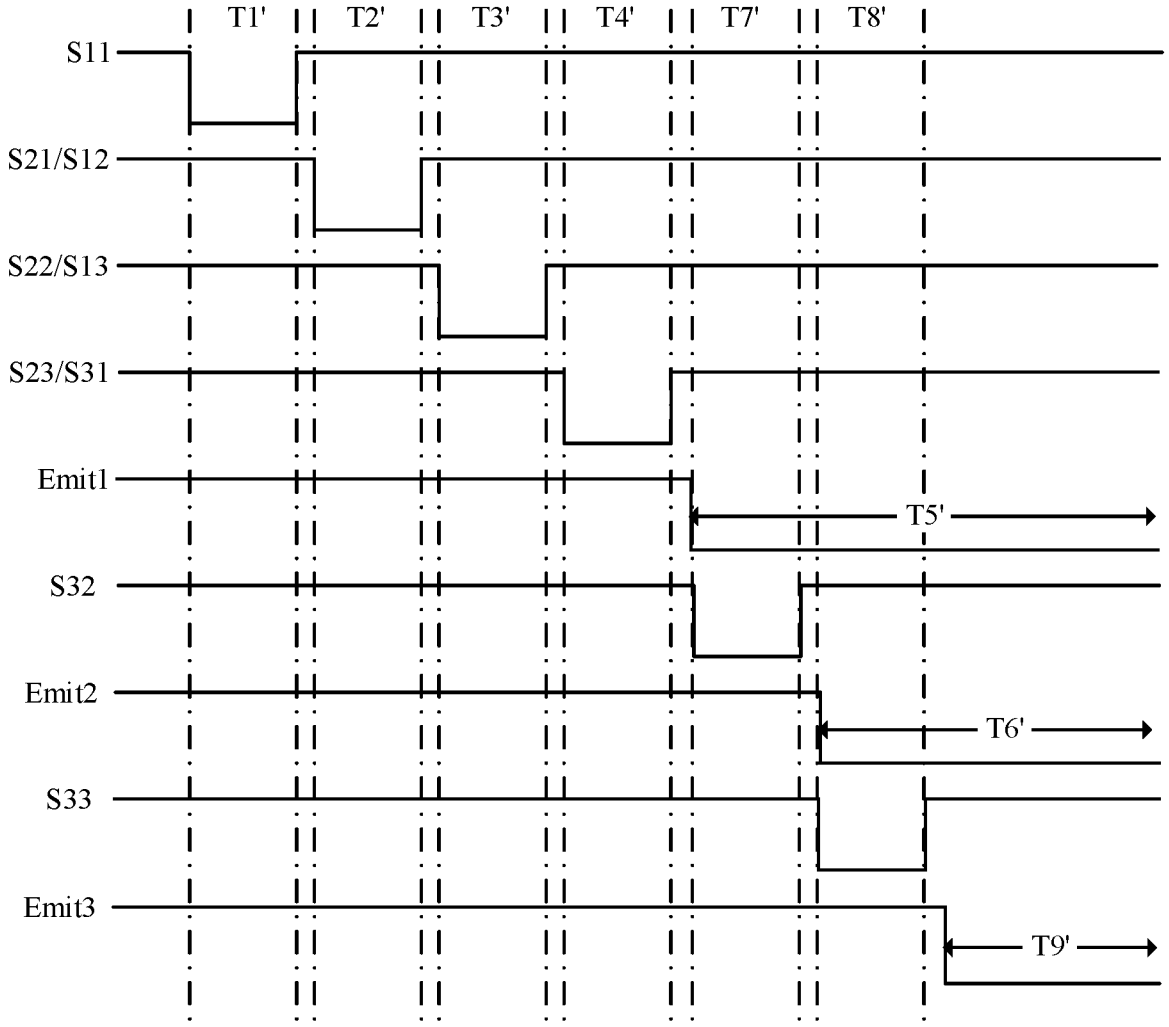
FIG. 21 is a timing view of a pixel circuit of the display panel corresponding to FIG. 20.

FIG. 21 is a timing view of a pixel circuit of the display panel corresponding to FIG. 20. The same parts of FIG. 21 and FIG. 19 may refer to the above description of FIG. 19, which will not be described in detail herein, and only the differences between FIG. 20 and FIG. 19 will be exemplarily described here. As shown in conjunction with FIGS. 21 and 20, the second scan signal S22 received by the pixel circuit 120 located in the $(i+1)^{th}$ row is multiplexed as the first scan signal S13 received by the pixel circuit 130 located in the $(i+2)^{th}$ row; after the initialization phase T3' of the pixel circuit 130 (i.e., the data writing phase T3' of the pixel circuit 120) ends, the data writing phase T4' of the pixel circuit 130 is entered; at this time, the third scan signal S31 received by the potential adjustment transistor M3 electrically connected to the first pixel circuit 110 located in the $i^{th}$ row may be multiplexed as the second scan signal S23 received by the pixel circuit 130 located in the $(i+2)^{th}$ row, so that the data writing phase T4' of the pixel circuit 130 is the potential adjustment phase T4' of the first pixel circuit 110.

Correspondingly, when the potential adjustment phase T4' of the first pixel circuit 110 is set after the data writing phase T3' of the pixel circuit 120, in the data writing phase T3' of the pixel circuit 120, a data signal is written into the second node N2 of the pixel circuit 120 until the potential of the second node N2 of the pixel circuit 120 is $Vd+\Delta V1-|Vth|$; after the potential adjustment phase T4' of the first pixel circuit 110 is entered, the potential adjustment transistor M3 of the potential adjustment module 21 is turned on, the second node N2 of the pixel circuit 120 adjusts the first nodes N11 and N12 of the first pixel circuit 110, and meanwhile, the first nodes N11 and N12 of the first pixel circuit 110 also affect the potential of the second node N2 of the pixel circuit 120.

Under the affect of the first nodes N11 and N12 of the first pixel circuit 110, the potential of the second node N2 of the pixel circuit 120 decreases by $\Delta V1$, so that after the potential adjustment phase T4 of the first pixel circuit 110, the potential of the second node N2 of the pixel circuit 120 becomes $Vd-|Vth|$, which is a potential after the threshold voltage of the driving transistor T of the pixel circuit 120 is compensated, at this time, when the driving transistor T of the pixel circuit 120 drives the light emitting module 12 of the driving transistor T to emit light according to the potential of the second node N2 of the pixel circuit 120, the light emitting brightness of the light emitting module of the pixel circuit 120 is a display gray scale corresponding to the pixel circuit 120 in this frame of picture; as such, even if the potential adjustment phase T4' of the first pixel circuit 110 is set after the data writing phase T3' of the pixel circuit 120, it can ensure that the light emitting module 12 of the pixel circuit 120 has the corresponding light emitting brightness.

Similarly, the pixel circuit 120 is the first pixel circuit located in the $(i+1)^{th}$ row, and the third scan signal S31 received by the potential adjustment transistor M3 electrically connected to the first pixel circuit 120 located in the $(i+1)^{th}$ row may be multiplexed as the second scan signal received by the pixel circuit in the $+_3)^{th}$ row.

When each pixel circuit further includes a light emitting control module, and the light emitting control module is configured to control the driving current provided by the driving transistor to flow into the light emitting module in the light emitting phase, the light emitting control module may include a light emitting control transistor. This light emitting control transistor is disposed in series between a first power signal end and the light emitting module; and a gate electrode of the light emitting control transistor is configured to receive a light emitting control signal, and the light emitting control transistor is turned on or off under the control of the light emitting control signal.

With continued reference to FIGS. 20 and 21, termination time of an enabling phase of the second scan signal S23 received by each pixel circuit 130 in the $(i+2)^{th}$ row is before starting time of an enabling phase T6' of the light emitting control signal Emit2 received by each pixel circuit 120 in the $(i+1)^{th}$ row. When the third scan signal S31 received by the gate electrode of the potential adjustment transistor M3 of the potential adjustment module 21 electrically connected to the first pixel circuit 110 located in the $i^{th}$ row is multiplexed as the second scan signal S23 received by the pixel circuit 130 located in the $(i+2)^{th}$ row, the potential adjustment phase T4' of the first pixel circuit 110 in the $i^{th}$ row is before the light emitting phase T6' of the pixel circuit 120 in the $(i+1)^{th}$ row; at this time, the data signal may be written into the second node N2 of the pixel circuit 120 in the data writing phase T3' of the pixel circuit 120 until the potential of the second node N2 of the pixel circuit 120 is $Vd+\Delta V1-|Vth|$, so that it ensures that the light emitting module 12 of the pixel circuit 120 has the corresponding light emitting brightness in the light emitting phase T6' of the pixel circuit 120. Similarly, the third scan signal S32 received by the gate electrode of the potential adjustment transistor M3 of the potential adjustment module 22 electrically connected to the pixel circuit 120 located in the $(i+1)^{th}$ row is multiplexed as the second scan signal received by the pixel circuit (not shown in the figures) in the $+3)^{th}$ row, so that the potential adjustment phase T7' of the pixel circuit 120 in the $(i+1)^{th}$ row is before the light emitting phase T9' of the pixel circuit 130 located in the $(i+2)^{th}$ row; the third scan signal S33 received by the gate electrode of the potential adjustment transistor M3 of the potential adjustment module 23 electrically connected to the pixel circuit 130 located in the $(i+2)^{th}$ row is multiplexed as the second scan signal received by the pixel circuit (not shown in the figures) located in an $(i+4)^{th}$ row so that the potential adjustment phase T8' of the pixel circuit 130 located in the $(i+2)^{th}$ row is before the light emitting phase of the pixel circuit located in the $(i+3)^{th}$ row. Accordingly, the potential adjusting period T4' of the first pixel circuit 110 located in the $i^{th}$ row is also before the light emitting period T5' of the pixel circuit 110 located in the $i^{th}$ row, so as to prevent that potentials between the first nodes N11 and N12 of the first pixel circuit 110 and the second node N2 of the first pixel circuit 110 are not within the preset potential difference range in the light emitting period T5' of the first pixel circuit 110 located in the $i^{th}$ row, which affects the light emitting module of the first pixel circuit 110 in the $i^{th}$ row to emit light stably. Similarly, the potential adjusting period T7' of the pixel circuit 120 in the $(i+1)^{th}$ row is also before the light emitting period T6' of the pixel circuit 120 in the $(i+1)^{th}$ row, and the potential adjusting period T8' of the pixel circuit 130 in the $(i+2)^{th}$ row is also before the light emitting period T9' of the pixel circuit 130 in the $+_2)^{th}$ row.

Based on the same inventive concept, the embodiments of the present disclosure further provide a driving method of a display panel. The driving method of the display panel is used for driving the display panel provided in the embodiments of the present disclosure, therefore the driving method of the display panel has the technical features of the display panel provided by the embodiments of the present disclosure. For the similarities, reference may be made to the above description of the display panel provided by the embodiments of the present disclosure.

Figure 22:
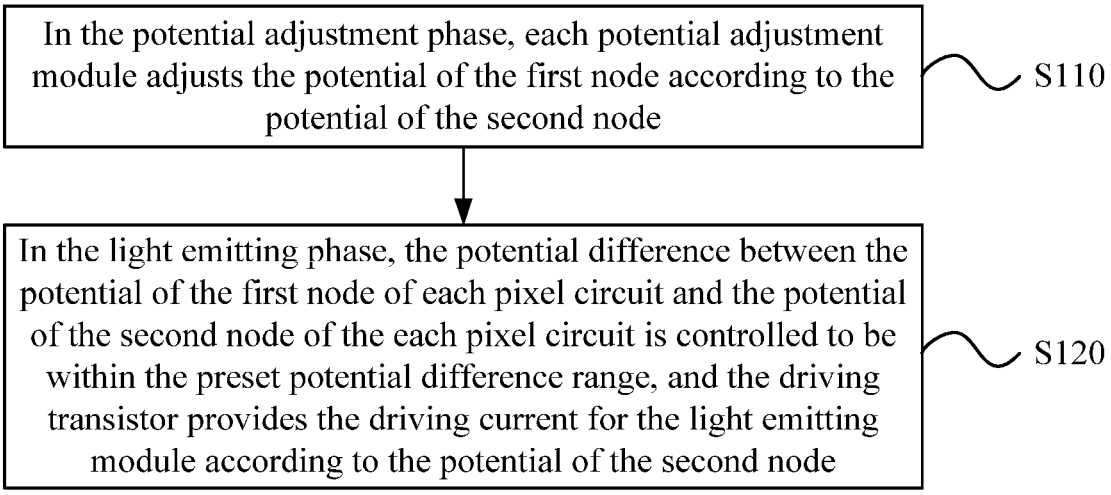
FIG. 22 is a flowchart of a driving method of a pixel circuit in a display panel provided by an embodiment of the present disclosure.

A driving period of each pixel circuit in the display panel includes a potential adjustment phase and a light emitting phase. FIG. 22 is a flowchart of a driving method of a pixel circuit in a display panel provided by an embodiment of the present disclosure. As shown in FIG. 22, the driving method of the pixel circuit in the display panel includes steps described below.

In step S110, in the potential adjustment phase, each potential adjustment module adjusts the potential of the first node according to the potential of the second node.

In step S120, in the light emitting phase, the potential difference between the potential of the first node of each multiple pixel circuit and the potential of the second node of the each pixel circuit is controlled to be within the preset potential difference range, and the driving transistor provides the driving current for the light emitting module according to the potential of the second node.

As such, in the potential adjustment phase of each pixel circuit, the potential of the first node of the pixel circuit may be adjusted through the respective potential adjustment module according to the potential of the second node of the pixel circuit or the potential of the second node of another pixel circuit, so that the potential of the first node of the pixel circuit and the potential of the second node of the pixel circuit may be kept within a preset range in the light emitting phase, the leakage current generated by the potential difference between the first node and the second node of the pixel circuit may be reduced, the potential of the second node is stable in the light emitting phase, the driving transistor can provide a stable driving current for the light emitting module so as to drive the light emitting module to emit light stably, and the display effect of the display panel is improved. Meanwhile, the potential of the first node of the pixel circuit is adjusted by the potential adjustment module according to the potential of the second node of the pixel circuit in the display panel, so that the potential difference between the first node and the second node of the pixel circuit may be accurately adjusted to be within the preset potential difference range, and a potential adjustment signal for adjusting the potential of the first node of each pixel circuit does not need to be additionally provided for each pixel circuit, thereby being conducive to simplifying the structure of the display panel and reducing the power consumption of the display panel.

When the at least one switching module of the pixel circuit includes a first switching module, a first electrode of the first transistor of the first switching module is configured to receive an initialization signal, a gate electrode of the first transistor of the first switching module and a gate electrode of the second transistor of the first switching module are both configured to receive a first scan signal, the driving period of each pixel circuit further includes an initialization phase before the potential adjustment phase, and in the initialization phase, the first scan signal controls both the first transistor and the second transistor of the first switching module to be turned on, and the initialization signal is transmitted to the gate electrode of the driving transistor through the turned-on first transistor and the turned-on second transistor, so as to initialize the driving transistor. Alternatively, when the at least one switching module of the pixel circuit includes a second switching module, a first electrode of the first transistor of the second switching module is electrically connected to a second electrode of the driving transistor, a gate electrode of the first transistor of the second switching module and a gate electrode of the second transistor of the second switching module are both configured to receive a second scan signal, the driving period of each pixel circuit further includes a data writing phase before the potential adjustment phase, and in the data writing phase, the second scan signal controls both the first transistor and the second transistor of the second switching module to be turned on, so as to compensate the gate electrode of the driving transistor with a threshold voltage of the driving transistor.

Figure 23:
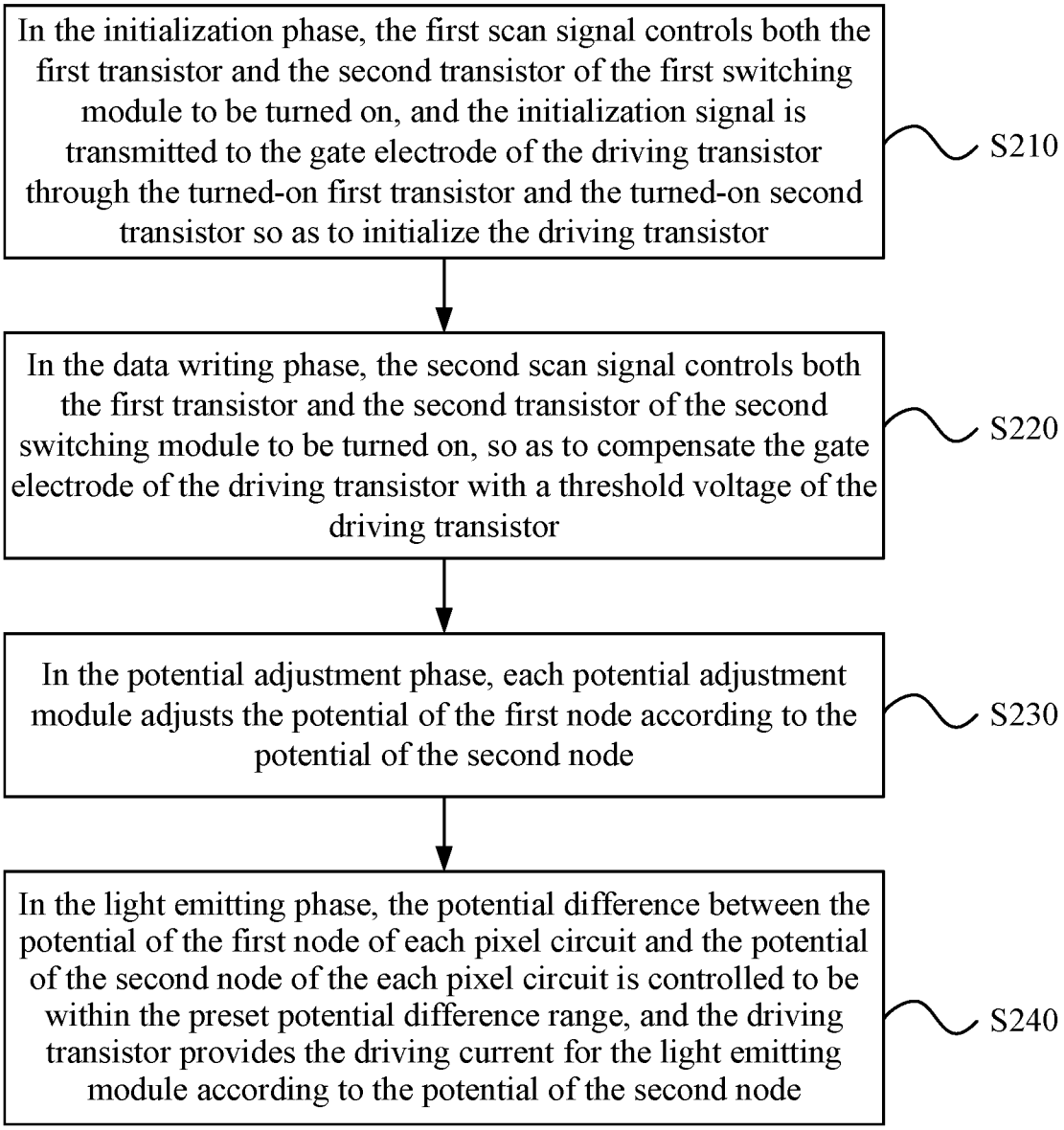
FIG. 23 is a flowchart of yet another driving method of a pixel circuit in a display panel provided by an embodiment of the present disclosure.

Illustratively, each pixel circuit including two switching modules, that is, each pixel circuit including a first switching module and a second switching module is used as an example. FIG. 23 is a flowchart of yet another driving method of a pixel circuit in a display panel provided by an embodiment of the present disclosure. As shown in FIG. 23, the driving method of the pixel circuit in the display panel includes steps described below.

In step S210, in the initialization phase, the first scan signal controls both the first transistor and the second transistor of the first switching module to be turned on, and the initialization signal is transmitted to the gate electrode of the driving transistor through the turned-on first transistor and the turned-on second transistor so as to initialize the driving transistor.

In step S220, in the data writing phase, the second scan signal controls both the first transistor and the second transistor of the second switching module to be turned on, so as to compensate the gate electrode of the driving transistor with a threshold voltage of the driving transistor.

Each pixel circuit may further include a data writing module; the data writing module includes a data writing transistor; a gate electrode of the data writing transistor is configured to receive a second scan signal, a first electrode of the data writing transistor is configured to receive a data signal, and a second electrode of the data writing transistor is electrically connected to the first electrode of the driving transistor. At this time, in the data writing phase of each pixel circuit, the second scan signal also controls the data writing transistor to be turned on, so that the data signal is written into the second node through the turned-on data writing transistor; and at this time, the potential adjustment phase of the pixel circuits in an $i^{th}$ row may be the same phase as the data writing phase of the pixel circuits in an $(i+1)^{th}$ row, so that the third scan signal received by the potential adjustment transistor of the potential adjustment module may be multiplexed as the second scan signal of the pixel circuits located in the $(i+1)^{th}$ row. Alternatively, the potential adjustment phase of the pixel circuits in the $i^{th}$ row may be the same phase as the data writing phase of the pixel circuits in the $(i+2)^{th}$ row, so that the third scan signal received by the potential adjustment transistors of the potential adjustment module may be multiplexed as the second scan signal of the pixel circuits located in the $(i+2)^{th}$ row; and i is an integer greater than or equal to 1.

In step S230, in the potential adjustment phase, each potential adjustment module adjusts the potential of the first node according to the potential of the second node.

In step S240, in the light emitting phase, the potential difference between the potential of the first node of each pixel circuit and the potential of the second node of the each pixel circuit is controlled to be within the preset potential difference range, and the driving transistor provides the driving current for the light emitting module according to the potential of the second node.

When the pixel circuits electrically connected to the input end and the output end of the potential adjustment module are a pixel circuit located in an $i^{th}$ row and a pixel circuit located in an $(i+1)^{th}$ row, respectively, each pixel circuit may further include a light emitting control module, and the light emitting control module includes at least one light emitting control transistor, the at least one light emitting control transistor is disposed in series between the first power signal end and the light emitting module, and a gate electrode of each light emitting control transistor is configured to receive a light emitting control signal. At this time, the light emitting phase of each pixel circuit includes: the potential difference between the potential of the first node of the pixel circuit and the potential of the second node of the pixel circuit is within the preset potential difference range; the light emitting control signal controls the light emitting control transistor to be turned on, so that the driving current, which is provided by the driving transistor according to the potential of the second node, flows into the light emitting module so as to drive the light emitting module to emit light. As such, the potential adjustment phase of the pixel circuits in the $i^{th}$ row is before the light emitting phase of the pixel circuits in the $(i+1)^{th}$ row, so as to ensure that the potentials of the second nodes of the pixel circuits in the $(i+1)^{th}$ row are stable in the light emitting phase of the pixel circuits in the $(i+1)^{th}$ row.

Based on the same inventive concept, the embodiments of the present disclosure further provide a display device. The display device includes the display panel provided by the embodiments of the present disclosure, therefore the display device provided by the embodiments of the present disclosure has the technical features of the display panel provided by the embodiments of the present disclosure, and can achieve the beneficial effects of the display panel provided by the embodiments of the present disclosure. For the similarities, reference may be made to the above description of the display panel provided by the embodiments of the present disclosure, which will not be described in detail herein.

Figure 24:
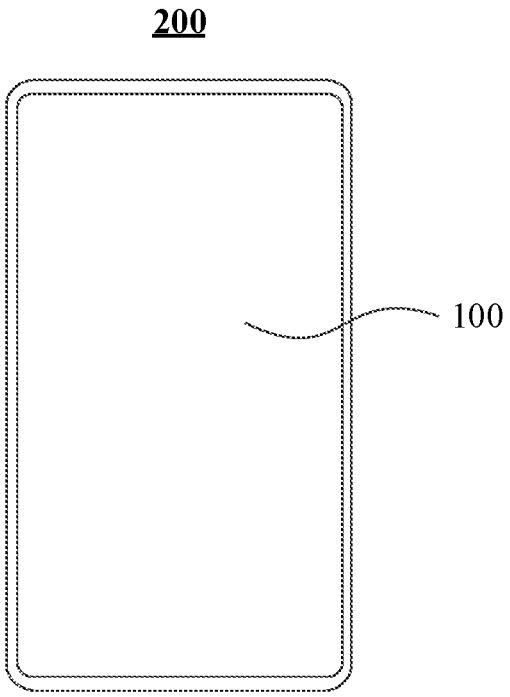
FIG. 24 is a schematic structural view of a display device provided by an embodiment of the present disclosure.

Illustratively, FIG. 24 is a schematic structural view of a display device provided by an embodiment of the present disclosure. As shown in FIG. 24, the display device 200 includes the display panel 100 described in any of the embodiments of the present disclosure. The display device 200 provided by the embodiments of the present disclosure may be a mobile phone shown in FIG. 24 or any electronic product with a display function, including but not limited to the following categories: a television, a notebook computer, a desktop display, a tablet computer, a digital camera, an intelligent bracelet, an intelligent glass, a vehicle-mounted display, medical equipment, industrial control equipment, a touch interaction terminal and the like, which is not particularly limited in the embodiments of the present disclosure.

It is to be noted that the above-mentioned contents are only the exemplary embodiments of the present disclosure and the technical principles applied thereto. It is to be understood by those skilled in the art that the present disclosure is not limited to the particular embodiments described herein, and that various variations, rearrangements and substitutions may be made without departing from the protection scope of the present disclosure. Therefore, although the present disclosure has been described in detail with reference to the above embodiments, the present disclosure is not limited to the above embodiments, and may further include other equivalent embodiments without departing from the concept of the present disclosure, and the scope of the present disclosure is defined by the appended claims.

What is claimed is:

1. A display panel, comprising:

a plurality of pixel circuits arranged in an array; wherein each of the plurality of pixel circuits comprises a driving transistor, at least one switching module and a light emitting module; each of the at least one switching module comprises a first transistor and a second transistor; a second electrode of the first transistor is electrically connected to a first electrode of the second transistor at a first node; a second electrode of the second transistor is electrically connected to a gate electrode of the driving transistor at a second node; the light emitting module comprises an organic light-emitting diode (OLED) element; and the driving transistor is configured to provide a driving current for the light emitting module according to a potential of the second node in a light emitting phase; and a plurality of potential adjustment modules; wherein an input end of each of the plurality of potential adjustment modules is electrically connected to the second node of one of the plurality of pixel circuits, an output end of each of the plurality of potential adjustment module is electrically connected to the first node of at least one of the plurality of pixel circuits; and each of the plurality of potential adjustment modules is configured to adjust a potential of the first node according to the potential of the second node so as to control, in the light emitting phase of the plurality of pixel circuits, a potential difference between the first node of each of the plurality of pixel circuits and the second node of the each of the plurality of pixel circuits to be within a preset potential difference range;

wherein a pixel circuit electrically connected to the output end of each of the plurality of potential adjustment modules is a first pixel circuit, and a pixel circuit electrically connected to the input end of each of the plurality of potential adjustment modules is a second pixel circuit;

wherein each of the plurality of potential adjustment modules comprises a potential adjustment transistor; a first electrode of the potential adjustment transistor is electrically connected to the second node of the second pixel circuit, a second electrode of the potential adjustment transistor is electrically connected to the first node of the first pixel circuit; a gate electrode of the potential adjustment transistor is configured to receive a third scan signal; and the potential adjustment transistor is turned on or off under the control of the third scan signal.

2. The display panel of claim 1, wherein the potential adjustment transistor comprises a double-gate transistor; the double-gate transistor comprises a third transistor and a fourth transistor; and a first electrode of the third transistor is electrically connected to the second node of the second pixel circuit, a second electrode of the third transistor is electrically connected to a first electrode of the fourth transistor, a second electrode of the fourth transistor is electrically connected to the first node of the first pixel circuit; and a gate electrode of the third transistor and a gate electrode of the fourth transistor are both configured to receive the third scan signal.

3. The display panel of claim 1, wherein the at least one switching module comprises at least one of:

a first switching module; wherein a first electrode of the first transistor of the first switching module is configured to receive an initialization signal, a gate electrode of the first transistor of the first switching module and a gate electrode of the second transistor of the first switching module are both configured to receive a first scan signal, and the first switching module is configured to transmit the initialization signal to the gate electrode of the driving transistor in an initialization phase;

or a second switching module; wherein a first electrode of the first transistor of the second switching module is electrically connected to a second electrode of the driving transistor, a gate electrode of the first transistor of the second switching module and a gate electrode of the second transistor of the second switching module are both configured to receive a second scan signal, and the second switching module is configured to compensate the gate electrode of the driving transistor with a threshold voltage of the driving transistor in a data writing phase.

4. The display panel of claim 3, wherein an aspect ratio of the potential adjustment transistor is less than an aspect ratio of at least one of the first transistor or the second transistor.

5. The display panel of claim 3, wherein each of the plurality of pixel circuits further comprises a data writing module; and the data writing module is configured to write a data signal into the second node in a data writing phase; and wherein the third scan signal received by the potential adjustment transistor electrically connected to the first pixel circuit in an $i^{th}$ row controls the potential adjustment transistor to be turned on after the data writing phase of the first pixel circuit in the $i^{th}$ row.

6. The display panel of claim 5, wherein the plurality of pixel circuits comprises (N +1) rows of pixel circuits; wherein N is an integer greater than or equal to 2;

wherein the first pixel circuit and the second pixel circuit, which are electrically connected to a same potential adjustment transistor, are a pixel circuit located in the $i^{th}$ row and a pixel circuit located in an $(i+1)^{th}$ row, respectively; $1 \leq i \leq N$ and i is an integer; and wherein the first node of each pixel circuit located in an $(N+1)^{th}$ row is electrically connected to the second node of one of the pixel circuits located in the $(N+1)^{th}$ row through a respective potential adjustment module.

7. The display panel of claim 5, wherein the plurality of pixel circuits comprises (N +1) rows of pixel circuits; wherein N is an integer greater than or equal to 2;

wherein the first pixel circuit and the second pixel circuit, which are electrically connected to a same potential adjustment transistor, are a pixel circuit located in the row and a pixel circuit located in an $(i+1)^{th}$ row, respectively; $1 \leq i \leq N$ and i is an integer; and wherein the first node of each pixel circuit located in an $(N+1)^{th}$ row is configured to receive a potential adjustment signal through a respective potential adjustment module.

8. The display panel of claim 5, wherein the first pixel circuit and the second pixel circuit, which are electrically connected to a same potential adjustment transistor, are a same pixel circuit; or the first pixel circuit and the second pixel circuit, which are electrically connected to a same potential adjustment transistor, are two different pixel circuits located in a same row.

9. The display panel of claim 8, wherein the data writing module comprises a data writing transistor; a gate electrode of the data writing transistor is configured to receive a second scan signal, a first electrode of the data writing transistor is configured to receive the data signal, a second electrode of the data writing transistor is electrically connected to a first electrode of the driving transistor; and the data writing transistor is turned on or off under the control of the second scan signal; and wherein the third scan signal received by the potential adjustment transistor electrically connected to at least one first pixel circuit located in the $i^{th}$ row is multiplexed as the second scan signal received by the data writing transistor of at least one pixel circuit located in an $(i+1)^{th}$ row; wherein i is an integer greater than or equal to 1.

10. The display panel of claim 5, wherein the first pixel circuit and the second pixel circuit, which are electrically connected to a same potential adjustment transistor, are a pixel circuit located in the $i^{th}$ row and a pixel circuit located in an $(i+1)^{th}$ row, respectively; wherein i is an integer greater than or equal to 1.

11. The display panel of claim 10, wherein the plurality of pixel circuits comprises (N +1) rows of pixel circuits; wherein N is an integer greater than or equal to 1;

wherein in each pixel circuit located in first N rows, the driving transistor is configured to provide the driving current for the respective light emitting module and drive the respective light emitting module to emit light;

wherein in each pixel circuit located in an $(N+1)^{th}$ row, the driving transistor is configured to provide the driving current for the respective light emitting module, and the respective light emitting module does not emit light; and wherein in each pixel circuit located in an $N^{th}$ row, the first node is electrically connected to a respective second node of the pixel circuit located in the $(N+1)^{th}$ row through a respective potential adjustment module.

12. The display panel of claim 10, wherein the data writing module comprises a data writing transistor; a gate electrode of the data writing transistor is configured to receive a second scan signal, a first electrode of the data writing transistor is configured to receive the data signal, and a second electrode of the data writing transistor is electrically connected to a first electrode of the driving transistor; the data writing transistor is turned on or off under the control of the second scan signal; and wherein the third scan signal received by the potential adjustment transistor electrically connected to at least one first pixel circuit located in the $i^{th}$ row is multiplexed as the second scan signal received by the data writing transistor of at least one pixel circuit located in an $(i+2)^{th}$ row, wherein i is an integer greater than or equal to 1.

13. The display panel of claim 12, wherein each of the plurality of pixel circuits further comprises a light emitting control module; and the light emitting control module is configured to control, in the light emitting phase, the driving current provided by the driving transistor to flow into the light emitting module.

14. The display panel of claim 13, wherein the light emitting control module comprises at least one light emitting control transistor; the at least one light emitting control transistor is disposed in series between a first power signal end and the light emitting module;

a gate electrode of each of the at least one light emitting control transistor is configured to receive a light emitting control signal, and the at least one light emitting control transistor is turned on or off under the control of the light emitting control signal; and wherein termination time of an enabling phase of the second scan signal received by each pixel circuit in the $(i+2)^{th}$ row is before starting time of an enabling phase of the light emitting control signal received by each pixel circuit in the $(i+1)^{th}$ row.

15. A driving method of a display panel, applied to a display panel, wherein the display panel comprises:

a plurality of pixel circuits arranged in an array; wherein each of the plurality of pixel circuits comprises a driving transistor, at least one switching module and a light emitting module; each of the at least one switching module comprises a first transistor and a second transistor; a second electrode of the first transistor is electrically connected to a first electrode of the second transistor or at a first node; a second electrode of the second transistor is electrically connected to a gate electrode of the driving transistor at a second node; the light emitting module comprises an organic light-emitting diode (OLED) element; and the driving transistor is configured to provide a driving current for the light emitting module according to a potential of the second node in a light emitting phase; and a plurality of potential adjustment modules; wherein an input end of each of the plurality of potential adjustment modules is electrically connected to the second node of one of the plurality of pixel circuits, an output end of each of the plurality of potential adjustment module is electrically connected to the first node of at least one of the plurality of pixel circuits; and each of the plurality of potential adjustment modules is configured to adjust a potential of the first node according to the potential of the second node so as to control, in the light emitting phase of the plurality of pixel circuits, a potential difference between the first node of each of the plurality of pixel circuits and the second node of the each of the plurality of pixel circuits to be within a preset potential difference range;

wherein a pixel circuit electrically connected to the Output end of each of the plurality of potential adjustment modules is a first pixel circuit, and a pixel circuit electrically connected to the input end of each of the plurality of potential adjustment modules is a second pixel circuit;

wherein each of the plurality of potential adjustment modules comprises a potential adjustment transistor; a first electrode of the potential adjustment transistor is electrically connected to the second node of the second pixel circuit, a second electrode of the potential adjustment transistor is electrically connected to the first node of the first pixel circuit; a gate electrode of the potential adjustment transistor is configured to receive a third scan signal; and the potential adjustment transistor is turned on or off under the control of the third scan signal;

wherein each of the plurality of pixel circuits in the display panel has a driving period comprising a potential adjustment phase and a light emitting phase; and wherein the method comprises:

in the potential adjustment phase, adjusting, by each of the plurality of potential adjustment modules, the potential of the first node according to the potential of the second node;

in the light emitting phase, controlling the potential difference between the potential of the first node of each of the plurality of pixel circuits and the potential of the second node of the each of the plurality of pixel circuits to be within the preset potential difference range, and providing, by the driving transistor, the driving current for the light emitting module according to the potential of the second node.

16. The driving method of claim 15, wherein the at least one switching module comprises at least one of a first switching module; wherein a first electrode of the first transistor of the first switching module is configured to receive an initialization signal, and a gate electrode of the first transistor of the first switching module and a gate electrode of the second transistor of the first switching module are both configured to receive a first scan signal;

the driving period of each of the plurality of pixel circuits further comprises an initialization phase before the potential adjustment phase; and the method further comprises:

in the initialization phase, controlling, by the first scan signal, both the first transistor and the second transistor of the first switching module to be turned on, and transmitting the initialization signal to the gate electrode of the driving transistor through the first transistor and the second transistor which are turned on, so as to initialize the driving transistor.

17. The driving method of claim 15, wherein the at least one switching module comprises at least one of a second switching module; wherein a first electrode of the first transistor of the second switching module is electrically connected to a second electrode of the driving transistor, and a gate electrode of the first transistor of the second switching module and a gate electrode of the second transistor of the second switching module are both configured to receive a second scan signal;

the driving period of each of the plurality of pixel circuits further comprises a data writing phase before the potential adjustment phase; and the method further comprises:

in the data writing phase, controlling, the second scan signal, both the first transistor and the second transistor of the second switching module to be turned on, so as to compensate the gate electrode of the driving transistor with a threshold voltage of the driving transistor.

18. The driving method of claim 15, wherein each of the plurality of pixel circuits further comprises a data writing module; the data writing module comprises a data writing transistor; a gate electrode of the data writing transistor is configured to receive a second scan signal, a first electrode of the data writing transistor is configured to receive a data signal, and a second electrode of the data writing transistor is electrically connected to a first electrode of the driving transistor;

wherein the driving period of each of the plurality of pixel circuits further comprises a data writing phase before the potential adjustment phase;

wherein the method further comprises: in the data writing phase, controlling, by the second scan signal, the data writing transistor to be turned on, so as to write the data signal into the second node through the turned-on data writing transistor; and wherein the potential adjustment phase of pixel circuits in an $i^{th}$ row and the data writing phase of pixel circuits in an $(i+1)^{th}$ row are a same phase; or the potential adjustment phase of pixel circuits in an $i^{th}$ row and the data writing phase of pixel circuits in an $(i+2)^{th}$ row are a same phase; wherein i is an integer greater than or equal to 1.

19. The driving method of claim 18, wherein each of the plurality of pixel circuits further comprises a light emitting control module; the light emitting control module comprises at least one light emitting control transistor; the at least one light emitting control transistor is disposed in series between a first power signal end and the light emitting module; and a gate electrode of each of the at least one light emitting control transistor is configured to receive a light emitting control signal;

wherein the method comprises: in the light emitting phase, controlling the potential difference between the potential of the first node of each of the plurality of pixel circuits and the potential of the second node of the each of the plurality of pixel circuits to be within the preset potential difference range; and controlling, by the light emitting control signal, the at least one light emitting control transistor to be turned on, so that the driving current, which is provided by the driving transistor according to the potential of the second node, flows into the light emitting module to drive the light emitting module to emit light;

wherein the potential adjustment phase of the pixel circuits in the $i^{th}$ row is before the light emitting phase of the pixel circuits in the $(i+1)^{th}$ row.

20. A display device, comprising a display panel, wherein the display panel comprise:

a plurality of pixel circuits arranged in an array; wherein each of the plurality of pixel circuits comprises a driving transistor, at least one switching module and a light emitting module; each of the at least one switching module comprises a first transistor and a second transistor; a second electrode of the first transistor is electrically connected to a first electrode of the second transistor or at a first node; a second electrode of the second transistor is electrically connected to a gate electrode of the driving transistor at a second node; the light emitting module comprises an organic light-emitting diode (OLED) element; and the driving transistor is configured to provide a driving current for the light emitting module according to a potential of the second node in a light emitting phase; and a plurality of potential adjustment modules; wherein an input end of each of the plurality of potential adjustment modules is electrically connected to the second node of one of the plurality of pixel circuits, an output end of each of the plurality of potential adjustment module is electrically connected to the first node of at least one of the plurality of pixel circuits; and each of the plurality of potential adjustment modules is configured to adjust a potential of the first node according to the potential of the second node so as to control, in the light emitting phase of the plurality of pixel circuits, a potential difference between the first node of each of the plurality of pixel circuits and the second node of the each of the plurality of pixel circuits to be within a preset potential difference range;

wherein a pixel circuit electrically connected to the Output end of each of the plurality of potential adjustment modules is a first pixel circuit, and a pixel circuit electrically connected to the input end of each of the plurality of potential adjustment modules is a second pixel circuit;

wherein each of the plurality of potential adjustment modules comprises a potential adjustment transistor; a first electrode of the potential adjustment transistor is electrically connected to the second node of the second pixel circuit, a second electrode of the potential adjustment transistor is electrically connected to the first node of the first pixel circuit; a gate electrode of the potential adjustment transistor is configured to receive a third scan signal; and the potential adjustment transistor is turned on or off under the control of the third scan signal.

* * * * *